US007850276B2

(12) United States Patent
Lugaresi et al.

(10) Patent No.: US 7,850,276 B2
(45) Date of Patent: Dec. 14, 2010

(54) RADIAL SLED PRINTING APPARATUS AND METHODS

(75) Inventors: Thomas J. Lugaresi, Los Gatos, CA (US); Clayton G. Gardner, Alamo, CA (US); George L. Bradshaw, Palo Alto, CA (US); Randy Q. Jones, Sunnyvale, CA (US); Jan E. Unter, Alamo, CA (US)

(73) Assignee: Elesys, Inc., Sunnyvale, CA (US)

( * ) Notice: Subject to any disclaimer, the term of this patent is extended or adjusted under 35 U.S.C. 154(b) by 0 days.

(21) Appl. No.: 11/117,936

(22) Filed: Apr. 28, 2005

(65) Prior Publication Data

US 2005/0206661 A1 Sep. 22, 2005

Related U.S. Application Data

(63) Continuation-in-part of application No. 10/935,805, filed on Sep. 7, 2004, now Pat. No. 7,284,804, and a continuation-in-part of application No. 10/207,662, filed on Jul. 26, 2002, now Pat. No. 7,085,017, and a (Continued)

Related U.S. Application Data

(60) Provisional application No. 60/566,468, filed on Apr. 28, 2004, provisional application No. 60/284,847, filed on Apr. 18, 2001, provisional application No. 60/284,605, filed on Apr. 17, 2001, provisional application No. 60/208,759, filed on Jun. 2, 2000, provisional application No. 60/191,317, filed on Mar. 21, 2000, provisional application No. 60/654,168, filed on Feb. 18, 2005.

(51) Int. Cl.

| | |
|---|---|
| ***B41J 2/165*** | (2006.01) |
| ***B41J 3/00*** | (2006.01) |
| ***B41J 2/01*** | (2006.01) |

(52) U.S. Cl. ..... 347/29; 347/2; 347/104

(58) Field of Classification Search ..... 347/2, 347/5, 8, 9, 14, 16, 19, 101, 104, 107, 22, 347/29, 32, 33, 37, 38; 358/1.11, 1.18, 3.2; 346/137; 101/35, 38.1

See application file for complete search history.

(56) References Cited

U.S. PATENT DOCUMENTS 5,317,337 A * 5/1994 Ewaldt ..... 347/2

(Continued)

FOREIGN PATENT DOCUMENTS

| | | | |
|---|---|---|---|
| JP | 09265760 A | * | 10/1997 |
| WO | 00/32399 A1 | | 6/2000 |
| WO | WO 0032399 A1 | * | 6/2000 |

OTHER PUBLICATIONS

ISA/US, International Search Report for International Application No. PCT/US05/15165, 4 pages, Oct. 5, 2006.

*Primary Examiner*—Stephen D Meier
*Assistant Examiner*—Leonard S Liang
(74) *Attorney, Agent, or Firm*—Jones IP Group

(57) ABSTRACT

Disclosed are apparatus and methods for implementing a radial sled printer device that substantially simplifies the complexity and reduces system costs and size for radial printing devices, both for devices that print and those that also record and print a label on circular media. In an embodiment, a print head is radially mounted in a substantially fixed position over a platter such that said platter moves as a sled under the print head for dispensing ink object along a radius or a line parallel to a radius as the media spins, effecting labeling of the media. In an alternate embodiment, a print head is radially mounted in a fixed position over an optical recording drive such that said drive moves as a sled under the print head for dispensing ink object along a radius as the media spins, affecting recording and labeling the media in a single insertion of the media.

19 Claims, 20 Drawing Sheets

Related U.S. Application Data continuation-in-part of application No. 10/127,948, filed on Apr. 22, 2002, now Pat. No. 6,986,559, which is a continuation-in-part of application No. 10/125,681, filed on Apr. 18, 2002, now Pat. No. 6,786,563, which is a continuation-in-part of application No. 10/125,777, filed on Apr. 17, 2002, now Pat. No. 6,854,841, application No. 11/117,936, filed on Apr. 28, 2005, which is a continuation-in-part of application No. 10/159,729, filed on May 30, 2002, now Pat. No. 6,910,750, which is a continuation-in-part of application No. 09/872,345, filed on Jun. 1, 2001, now abandoned, application No. 11/117,936, which is a continuation-in-part of application No. 10/848,537, filed on May 17, 2004, now Pat. No. 7,497,534, which is a continuation-in-part of application No. 09/815,064, filed on Mar. 21, 2001, now Pat. No. 6,736,475, application No. 11/117,936, which is a continuation-in-part of application No. 09/873,010, filed on Jun. 1, 2001, now abandoned, which is a continuation of application No. 09/062,300, filed on Apr. 17, 1998, now Pat. No. 6,264,295.

(56) References Cited

U.S. PATENT DOCUMENTS

| | | | | |
|---|---|---|---|---|
| 6,202,550 | B1 * | 3/2001 | Lee et al. | 101/38.1 |
| 6,264,295 | B1 * | 7/2001 | Bradshaw et al. | 347/2 |
| 6,550,891 | B1 * | 4/2003 | Berg | 347/33 |
| 6,580,444 | B1 * | 6/2003 | Drynkin et al. | 347/171 |
| 6,619,792 | B1 * | 9/2003 | Roberts et al. | 347/101 |
| 2004/0223030 | A1 * | 11/2004 | Chang | 347/37 |

* cited by examiner

RADIAL SLED PRINTING APPARATUS AND METHODS

CROSS-REFERENCE TO RELATED APPLICATIONS

This application claims the benefit of U.S. Provisional Patent Application No. 60/566,468 filed Apr. 28, 2004.

This application also claims the benefit of U.S. Provisional Application No. 60/654,168 filed Feb. 18, 2005 entitled OFF-RADIAL-AXIS CIRCULAR PRINTING DEVICE AND METHODS.

This application is also a continuation-in-part of co-pending U.S. Utility patent application Ser. No. 10/207,662 filed Jul. 26, 2002 entitled POLAR HALFTONE METHODS FOR RADIAL PRINTING, which claims the benefit of U.S. Provisional Application No. 60/566,468 filed Aug. 3, 2001; and is a continuation-in-part of co-pending U.S. Utility patent application Ser. No. 10/127,948 filed Apr. 22, 2002 entitled POSITION INFORMATION APPARATUS AND METHODS FOR RADIAL PRINTING, by Carl E. Youngberg, which claims the benefit of U.S. Provisional Application No. 10/127,948 filed Apr. 22, 2001; and is a continuation-in-part of U.S. patent application Ser. No. 10/935,805 filed Sep. 7, 2004, now published as U.S. Publication No. 2005/0078142 on Apr. 14, 2005 which is a continuation-in-part of U.S. Utility patent application Ser. No. 10/125,681 filed on Apr. 18, 2002, now U.S. Pat. No. 6,786,563, issued Sep. 7, 2004 entitled INTERLEAVING APPARATUS AND METHODS FOR RADIAL PRINTING, by Randy Q. Jones, which claims the benefit of U.S. Provisional Application No. 60/284,847 filed Apr. 18, 2001; and is a continuation-in-part of U.S. patent application Ser. No. 11/058,941 filed Feb. 15, 2005, which is a continuation-in-part of U.S. Utility patent application Ser. No. 10/125,777 filed on Apr. 17, 2002, now U.S. Pat. No. 6,854,841, issued Feb. 15, 2005, entitled POINT OF INCIDENCE INK CURING MECHANISMS FOR RADIAL PRINTING by Jan E. Unter, which claims the benefit of U.S. Provisional Application No. 60/284,605 filed Apr. 17, 2001; and is a continuation-in-part of U.S. patent application Ser. No. 10/159,729 filed on May 30, 2002, now published as U.S. Publication No. 2002/0145636 on Oct. 10, 2002, entitled LOW PROFILE INK HEAD CARTRIDGE WITH INTEGRATED MOVEMENT MECHANISM AND SERVICE-STATION by Randy Q. Jones et al., which is a continuation-in-part of U.S. Utility patent application Ser. No. 09/872,345 filed Jun. 1, 2001 (abandoned), which claims the benefit of U.S. Provisional Application No. 60/208,759 filed Jun. 2, 2000; and is a continuation-in-part of U.S. patent application Ser. No. 10/848,537 filed May 17, 2004, now published as U.S. Publication No. 2004/0252142 on Dec. 16, 2004, which is a continuation-in-part of U.S. Utility patent application Ser. No. 09/815,064 filed on Mar. 21, 2001, now U.S. Pat. No. 6,736,475, issued May 18, 2004, entitled METHOD FOR PROVIDING ANGULAR POSITION INFORMATION FOR A RADIAL PRINTING SYSTEM by Carl E. Youngberg et al., which claims the benefit of U.S. Provisional Application No. 60/191,317 filed Mar. 21, 2000; and is a continuation-in-part of U.S. patent application Ser. No. 09/873,010 filed Jun. 1, 2001, now published as U.S. Publication No. 2004/0035886 on Nov. 1, 2001, which is a continuation of U.S. Utility patent application Ser. No. 09/062,300, filed Apr. 17, 1998, now U.S. Pat. No. 6,264,295 issued Jul. 24, 2001, entitled RADIAL PRINTING SYSTEM AND METHODS by George L. Bradshaw et al.; which patents and patent applications are incorporated herein by reference in their entirety for all purposes.

BACKGROUND OF THE INVENTION

The present invention relates to apparatus and methods for printing or imaging onto spinning circular media, such as optical media. Certain embodiments of the present invention pertain to a radial sled printing apparatus and methods that implement printing over a spinning media.

In the art of printing ink objects as it applies to radial printing, there is a need to build an inexpensive radial printer apparatus. By way of illustration and referring to aspects of the present invention, in FIG. 1, is shown a radial printer 10 having print head 110 operably mounted over media 100 to enable moving along path 106 via print head carriage holder 112, actuated by stepper motor 114 with lead screw 116. Ink objects from the print head 110 are discharged while the print head moves along path 106 over media 100 while spinning 102 to affect printing over the media's annular area 104. Print head 110 may also be configured to traverse sideways for precision imaging adjustments via motor 670 and lead screw 672, as well as backward into maintenance station 504.

One difficulty with crafting a radial printer is that higher-tolerance, precision components frequently are required to ensure that no distortion is caused during movement of the print head along a radial direction while radial printing. Any misalignment or improper positioning of the print head nozzles will create undesirable distortion as disclosed by the present inventor in U.S. Pat. No. 6,264,295 by Bradshaw et al. Precision components often increase the overall cost of manufacturing the radial printing apparatus. Furthermore, there is a continuous need to reduce the overall system size and cost for radial printers.

To reduce the overall system size and improve inherent image quality, a device is needed to lower the cost of radial printing a label and optionally recording a CD or DVD.

BRIEF SUMMARY OF THE INVENTION

According to aspects of the present invention, a radial sled printing system, including methods and apparatus, for receiving an image source representative of an image to be printed on an outer surface of a rotating media is disclosed. The image source typically has a plurality of image points.

In one embodiment, the radial sled printing system includes a sled configured to translate across a print head while rotating the media to print an image onto a surface of said media. In an alternative embodiment, the sled movement sequences the actuation and movement of print head maintenance components by cross-coupling power from the sled movement motor therein.

In another embodiment, the sled comprises a slimline CD or DVD drive, wherein the drive is configured, in conjunction with or, as the sled to translate across a print head while rotating the media to print an image onto a surface of said media. The drive may form the basis of a single-insertion, record and print device, in which the media is inserted once in the drive and that while thusly within the drive, a surface of the media is recorded with data while another surface of the media is printed and labeled with a print head. The recording and printing may occur at the same time or in sequence upon ejection of the media from the drive both sides of the media are complete: burned with data and printed with a label, respectively.

In yet another embodiment, the radial sled printing system includes a sled comprising a slimline CD or DVD drive, wherein the drive is configured, in conjunction with or, as the sled to translate across a print head while rotating the media to print an image onto a surface of said media and is operably mounted in combination with an operable print head and print head maintenance station in a standard, half-height-sized drive configuration. This more diminutive embodiment may be directly configured in a computer as part of a computer bay. The half-height-sized radial sled printing system may be further configured to use a print head in a low-profile configuration such that the print head may slide through a door on the front face of the drive and operably engage in printing. Components of the print head maintenance station within the drive keep the print head in an operable state when not printing.

In another embodiment a combination ink jet printer, radial sled and CD/DVD recorder printer is disclosed, which comprises an apparatus and methods combining a traditional photo inkjet printer with a radial sled printer configured with a slimline drive. This combined apparatus allows multiple uses using a single print cartridge: read digital film cards and record contents onto CD/DVD, print a label on the CD, browse the CD and print a plurality of photos therefrom. The use of a TV or other monitor is disclosed for monitoring, previewing the film card, and CD contents and selecting actions from menus to move content from film cards to CD/DVD and selecting contents to print a plurality of photos.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE SPECIFIC EMBODIMENTS

The present invention will now be described in detail with reference to aspects of various embodiments as illustrated in the accompanying drawings. In the following description, numerous specific details are set forth in order to provide a thorough understanding of the present invention. It will be apparent, however, to one skilled in the art, that embodiments of the present invention may be practiced without some or all of these specific details. In other instances, well known process steps and/or structures have not been described in detail in order to not unnecessarily obscure the discussion presented below.

For the scope of the present invention, the terms "CD" and "media" are intended to mean all varieties of optical recording devices that record media and their respective media discs, such as CD-R, CD-RW, DVD-R, DVD+R, DVD-RAM, DVD-RW, DVD+RW, Blu-ray, HD-DVD and the like, including full and reduced size media.

Figure 2A:
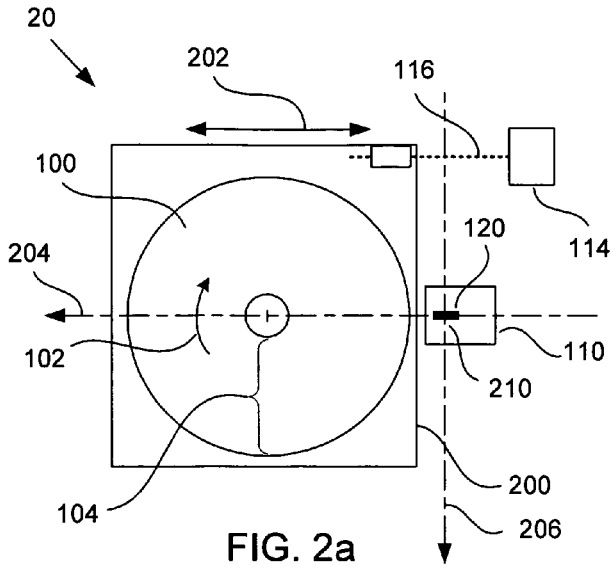
FIG. 2*a*~2*c*—Are diagrammatic representations of an exemplary radial sled printing system in various stages of printing.
Figure 2B:
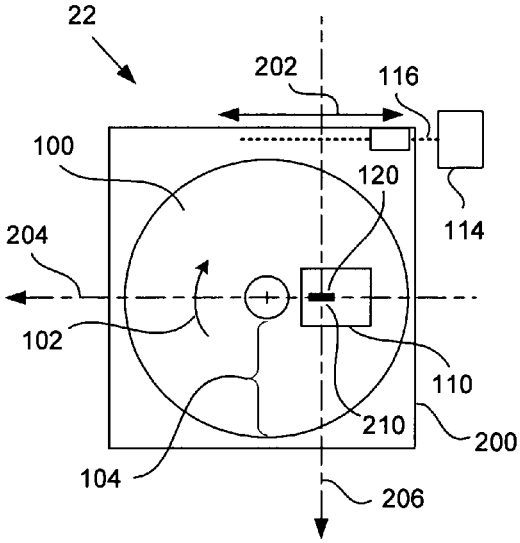
Figure 2C:
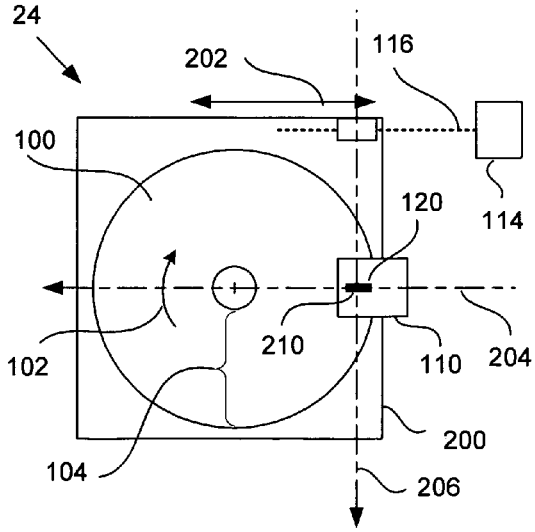

FIGS. 2*a*~2*c* illustrate the elements of a radial sled printer 20 according to aspects of the present invention. The embodiment of FIG. 2 illustrates a radial sled printer 20 that labels or both records and labels the media 100 while that media is rotating 102 on a sliding sled 200 under a stationary print head 110, such as an ink jet printhead. FIG. 2*a*~2*c* also illustrate aspects of an exemplary printing sequence of a radial sled printer. FIG. 2*a* shows sled 200 at rest in the media 100 leading position. FIG. 2*b* shows sled 200 fully moved into an initial printing position under print head 110. FIG. 2*c* shows sled 200 partially moved towards the initial loading position as the printer 24 finishes printing. As is apparent in these illustrations, whereas on the one hand, certain embodiments of the radial printers moves a print head over a spinning media, in contrast, certain embodiments of a radial sled printer according to the present invention move the media, often by way of moving the sled, under a substantially fixed, substantially immovable print head. In other embodiments, the print head may also be moved slightly in a radial or perpendicular to radial direction in relation to the spinning media for various reasons including to accomplishing higher print quality.

A slow moving radial sled printer 20 with lighter mass may be less likely to "bounce around" during printing when compared designs using a stationary media platform and a moving print head. An advantage of certain embodiments of a radial sled printer according to the present invention is that the print head can be completely stationary and can be rigidly affixed in the optimal position relative to the printing media. For embodiments of a radial sled printer of the present invention that utilize ink jet pens, typical pens have more mass due to ink than do laser head embodiments. By instead fixing the print head in one locus while gradually moving the sled with minimal motion, ancillary reactant forces from momentum are minimized during radial sled printing.

Another advantage of radial sled printing is that the printhead needs minimal alignment relative to the spinning media. Referring again to FIG. 2, a crucial facet of printing along a radius is to ensure a precise alignment of the print head firing nozzles 120 relative to the axis of the spindle motor along centerline 204. As disclosed in Bradshaw et al, any non-designed offset of the print head nozzles will create undesirable distortions. When instead the print head is substantially held in a fixed position relative to the spindle axis while printing, as with a radial sled printing apparatus, alignment is simplified, less costly and may be designed to be self-aligning.

Figure 1:
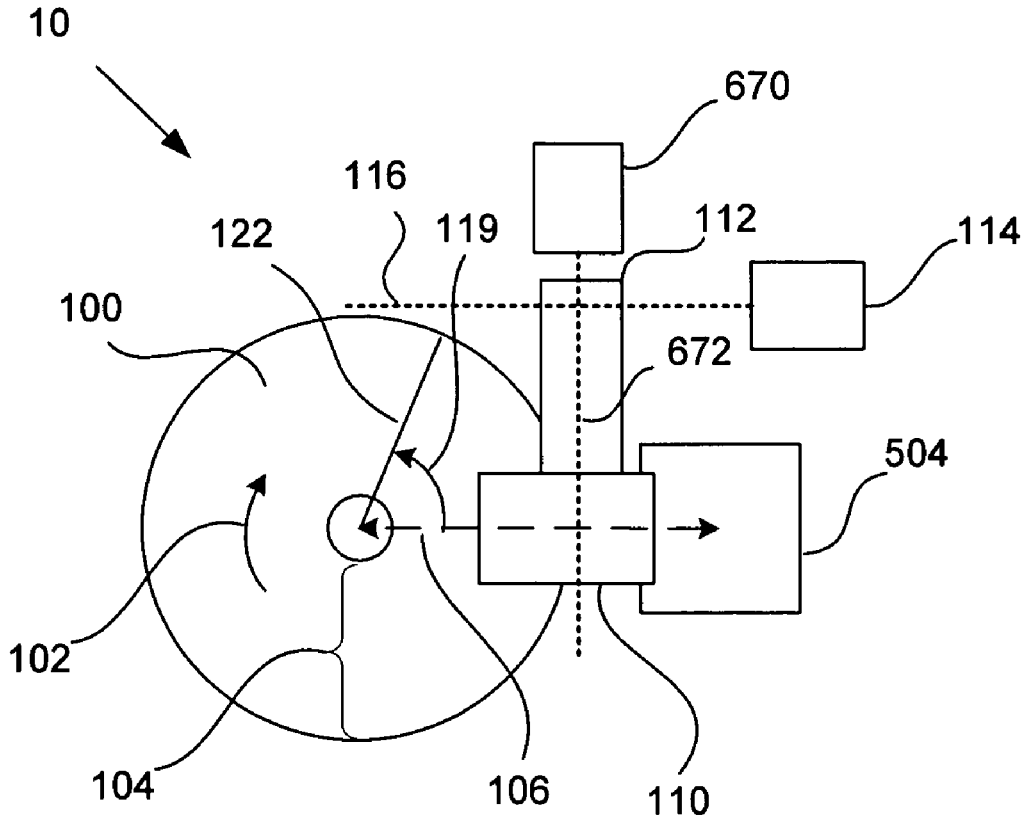
FIG. 1—Is a diagrammatic representation of all exemplary radial printing system.

In yet another advantage of radial sled printing is that it can reduce overall apparatus size, relative to radial printers such as shown in FIG. 1. Since the print head remains in a fixed position, space above the media is not necessary to allow the print head pen, which can be approximately 2 inches or greater in height, to move over the entire radius of the media. With embodiments of the radial sled of the present invention, the sled height of only approximately ½ inch or less is necessary for movement within a radial sled printing apparatus.

As described herein, radial sled printing reduces individual and overall apparatus costs and size as well as assures improved image quality by means of inherently self-aligning the print head pen relative to the CD or DVD spindle motor. Such a device can also be less expensively manufactured, uses less desktop space and operates in more confined areas, such as within a computer bay. In view of the foregoing, the present invention provides exemplary methods and an apparatus whereby the process of recording and printing labels on CDs is improved at a lower apparatus cost point.

In accordance with one aspect of the present invention, a printing device is mounted adjacent to a CD drive mounted on a radial-moving sled ("radial sled" or "sled"), such that the sled mechanism can be operably moved along a radius of the media while simultaneously spinning the media in proximity to a print head. Referring to FIG. 2, to affect printing, the media 100 is rotated 102 while the radial sled 200 substantially moves 202 continuously or incrementally along radial axis and sled centerline 204 so as to come in proximity of print head 110. Alternatively the sled may be moved incrementally in full- or partial-nozzle-array 120 size steps to produce a plurality of concentric-ring bands while printing. In the one embodiment, the media 100 continuously rotates 102 below a print head assembly 110 as the head assembly 110 dispenses ink objects onto the media 100. Alternatively, a plurality of print head assemblies 110 may be arrayed along x-axis 204 allowing for dispensing of a plurality of colorants onto media 100. The combined motions of the media 100 spinning under the print head 110 and the radial sled moving along the radius affects contiguous printing of an image along the annular direction on the media.

In alternate embodiments, the print head assembly or assemblies may be positioned along a line parallel to x-axis 204 but displaced from x-axis 204. In such embodiments, the print head is displaced only so far that still allows for printing of the amount of annular area on the media that is desired.

In alternate embodiments, the nozzle array 120 may be configured to be operably positioned two dimensionally, both parallel to the radial direction 204 and perpendicular to the radial direction 206. Such a configuration allows placement of the nozzle array substantially inside of annular print area in the media. To compute the individual nozzle or column of nozzle to fire, the differential nozzle column offset from the true radius is computed from the distance from the center of the spinning media combined with the lateral displacement from a true center radius directly mapped to the relevant nozzle position. The printer imaging control system renders the image and maps the appropriate firing of the nozzles accordingly. Additionally, the print head can be configured to accommodate slight lateral movement to facilitate high quality printing or improve printing speed.

Figure 3:
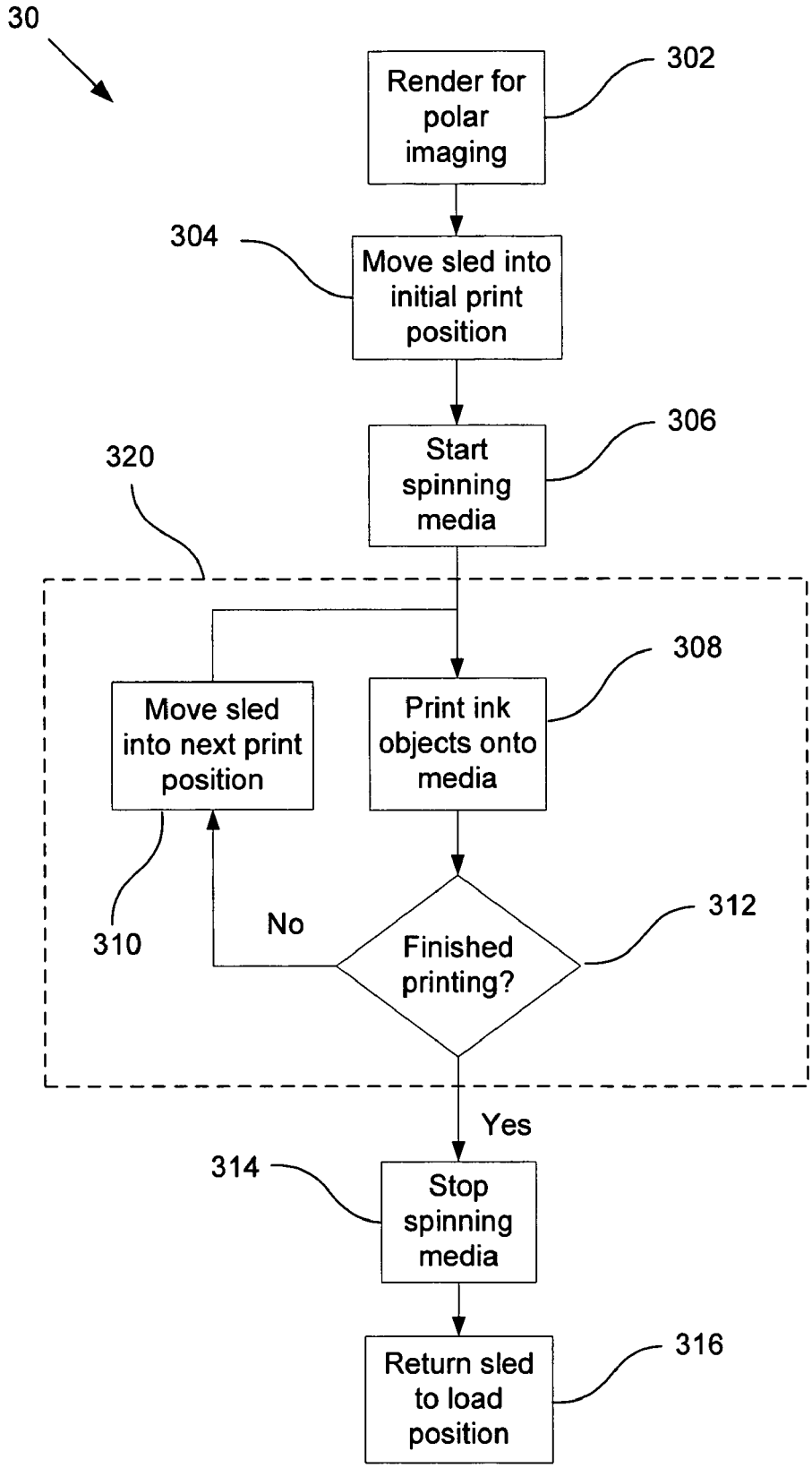
FIG. 3—Is a flowchart documenting an exemplary process for radial sled printing.
Figure 4:
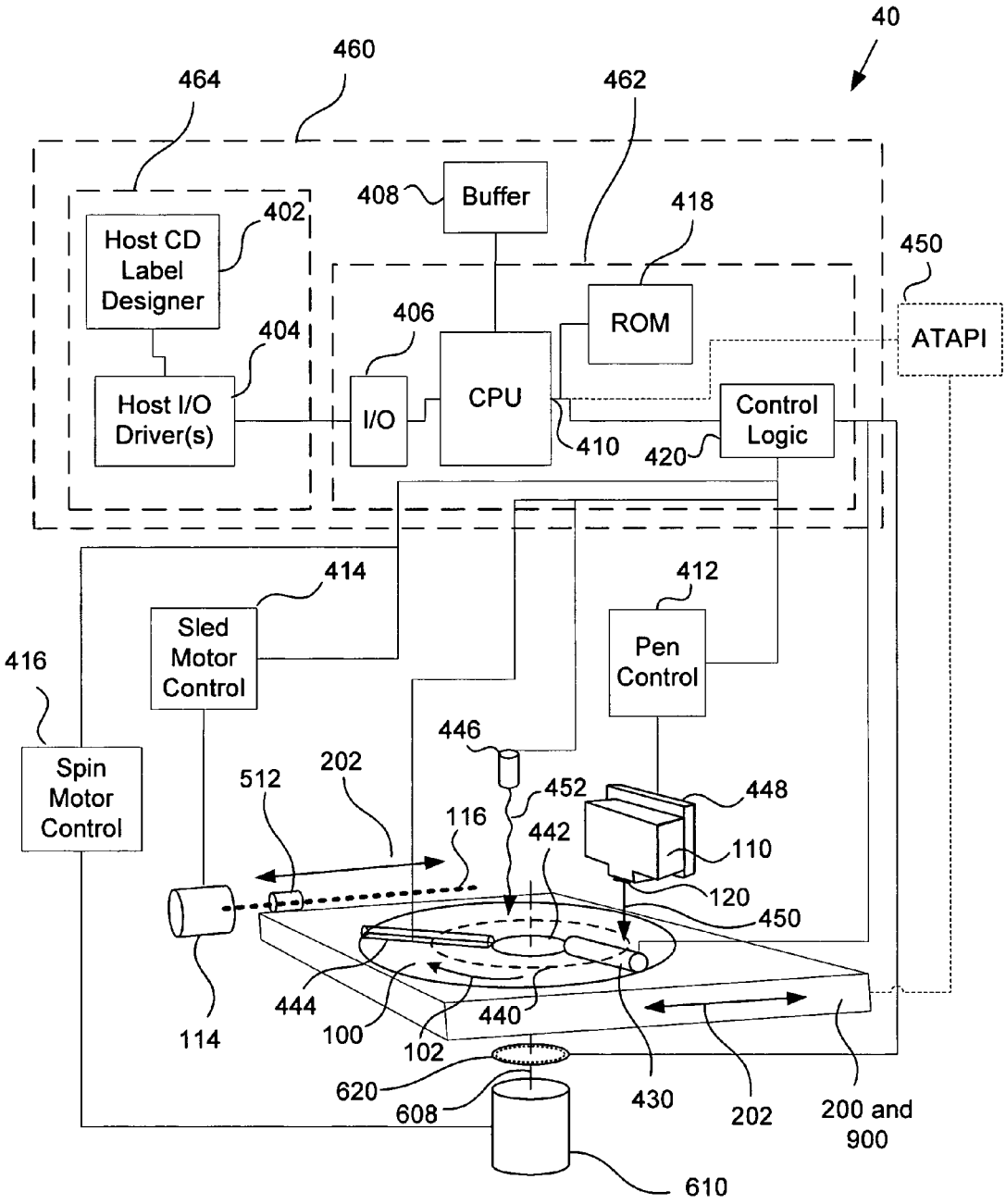
FIG. 4—Is an exemplary block diagram of a radial sled printing system.

FIGS. 3 and 4 illustrate aspects of an embodiment of a radial sled printing system in more detail. A detailed description of the method of printing an image using a radial sled printing system 40 according to this embodiment follows. Media 100 is positioned in sled 200 or drive 900 in hub 442 and spun 102 by motor 610 or drive 900. Either code wheel 620 or the drive's 900 motor poles or a combination of the drive's other signals, provide instantaneous angular position sensing, as respectively disclosed in prior referenced U.S. patent application Ser. No. 10/127,948 by Youngberg, incorporated by reference herein, and in prior referenced U.S. patent application Ser. No. 09/815,064 by Youngberg et al, incorporated by reference herein. A phase-lock loop (PLL) may be used to precisely monitor and synchronize printing to the angular speed of the spinning media, from among the variety of methods disclosed in U.S. patent application Ser. No. 10/848,537 by Struk et al, incorporated by reference herein. This PLL may be any of a variety of single or multiple-stage analog or digital devices or logic circuits, and additionally may be configured in standalone components or as part of the control logic circuitry 420 in a field programmable gate array (FPGA) or an application specific integrated circuit 420 (ASIC), apart from or configured as an integrated portion of an ASIC or system-on-a-chip (SoC) device 462, configured with additional components from among those in the radial printing system 40.

According to this embodiment, the image is rendered either in the host computer 462 or in the radial sled printing embedded system 462. Such may be accomplished by a variety of alternatives including by the embedded microprocessor 410 using polar conversion or rendering firmware from ROM 418, assisted by polar conversion or rendering circuitry 420 and optionally by a digital signal processor as part of the CPU 410. Such rendering may also be performed in a system-on-a-chip (SoC) integrated circuit 410, such as the Quatro 4100 from Zoran Corporation of Woburn, Mass. The SoC 410 like the Quatro 4100 may perform all or partial polar rendering, solely or in combination with the host or in combination with other radial print control logic circuitry 420 in the form of an FPGA or ASIC. The radial sled printer's operational control and the image rendering for said printer may alternately be performed in one or more custom-configured application specific integrated circuits, ASICs, incorporating a plurality of the functions, including, possibly, that of the above-stated circuitry (406~410 and 418~420) or system-on-a-chip 462 (SoC) devices. During printing, the pre-rendered, partially rendered or post-rendered polar image is transferred from host to radial sled printer 40 via the host input/output (I/O) drivers 404, through radial sled printer 40 I/O 406, such as USB, IEEE 1394, network or any other suitable physical I/O, and stored in buffer 408 such as SDRAM, DDRAM, and so on, awaiting further processing or printing.

In an alternative embodiment, the sled assembly 200 may include a curing bar 430, operably mounted to the sled 200 in proximity to the media 100 to affect drying or curing the media. Being affixed to the sled 200, the curing bar translates in direction 202 along with the sled and also the spinning media during printing. The cure bar may be any radiant or light-generating energy source, such as IR, UV, or convection hot air, suitable for drying or curing colorant. For example, if UV curable ink is used, a curing bar may be configured over the media 100 to cure the ink as it is deposited onto the media 100 by the nozzle array 120. By way of another example, the curing bar 430 may be be configured as a roller or ball bearing to crush microcapsules of ink on the label-side surface of the media 100, for example, where the media may be pre-coated with a layer of microencapsulation ink objects, disclosed in U.S. Pat. No. 4,985,484 by Yoshida et al. incorporated herein by reference and related prior disclosures, wherein the curing roller crushes the microcapsules as the media spins within the disc drive or upon the sled platter. Alternatively, a curing bar 430 in the form of a roller at least the width of the media diameter may be configured to roll and squeeze the media as the media slides out of a media unloading slots, such as a slot-load CD or DVD recorder.

In another alternative embodiment, the sled assembly 200 may include an optical reader 444, operably mounted to the sled 200 in proximity to the media 100 to affect scanning the label surface while the media 100 spins. The present invention may incorporate an optical reader from an existing OEM device, such as a CD R-writer, or may be integrated into a separate radial sled printer package. For example, the optical reader may be configured to scan a first printed image from the media 100 and output the first printed image in the form of an optical feedback signal to the imaging control system 460. The first printed image may then be manipulated to create, for example, a second image that is different than the first image and to output the second image to the imaging control system 460 in the form of a new image source. The second image may then be printed over the first image of the media 100. Alternatively, the first printed image may be printed onto another media 100. For example, the optical reader may scan and read a master image from a master CD and output the master image to the imaging control system 460. The master image may then be duplicated on a plurality of other CD's.

Alternatively, the optical reader may be configured above or below the media 100 to recognize a mark on the media 100 or the platter 440 to determine a reference point on the platter 440. For example, a particular mark on the platter 440 will indicate the zero angle radius 122 (FIG. 1) of the platter 440, as reference to measuring when to print an ink object at any given angle position 119 along radius 106. The reference point of the platter 440 may then be defined as a point on the platter 440 that is positioned at the zero angle radius and at an inner diameter (ID) of the platter 440. The reference point of the platter 440 corresponds to a reference point within the rendered image source 302 (FIG. 3). Likewise, each point in the image source 302 may then be matched with a particular point on the platter, wherein each image source point is in reference to the reference point of the image source 302 and the media 100.

Referring to FIG. 2~4, with an embodiment of the present invention, the radial sled printing system 40 sled motor control 414 moves the sled in operation 304 into initial print position 22 (FIG. 2) in close proximity to and under the print head assembly 110, then spins the media in operation 306 (FIG. 3) via spin motor control 416 (FIG. 4), and prints ink in operation 308 objects 450, firing the inkjet pen nozzles 120 with pen control 412. Alternatively, the step of spinning the media may be accomplished prior to moving the sled into proximity with the print head assembly. In another alternative embodiment of the present invention, the print head 110 is a light or laser source, irradiating the media 100 surface to produce an image on the printable surface, such as those utilizing laser-curable materials on the surface of the media as disclosed in U.S. Pat. No. 6,867,793 by Field fully incorporated herein by reference. The sled-move-print process 320 is repeated a plurality of times to completely print the annular area 104 as a test is made during each repetition to determine if finished 312: If not finished printing, then the sled 200 is moved via sled motor control 414 into next print position in operation 310 to print in operation 308 again; otherwise if finished printing or at the final print position 24, spin motor control 416 stops spinning the media in operation 314 and sled motor control 414 returns in operation 316 the sled 200 to the load position 20. In an alternative embodiment, the sled-move-print process 320 may be alternatively configured to start at position 24 and move to position 22 to finish printing.

In another aspect of an embodiment, a light source 446 may be operably mounted to the sled 200 in proximity to the media 100 to illuminate 452 all or a portion of the media 100 during the sled printing process 30, to provide for visual inspection of the media, before, during or after printing. Alternatively, the light source 446 may be a strobe light, controlled by and synchronized in the radial printing logic 420 to flash once or a plurality of times each rotation, providing stop-action visual inspection of the spinning media. A control knob, buttons, sliders, roll knobs or other tactile or host computer software controls may be optionally configured to visually turn the visual strobe image rotationally in a clockwise or counter-clockwise direction so as to allow inspecting all portions of the media 100 while spinning or printing, even areas of the media 100 normally obscured by the print head 110 during printing. The light source 446 may be any suitable incandescent, ultra violet, light emitting diode (LED), fluorescing or other visible-spectrum light source. Other decorative light sources 446 may be optionally added to enhance the visual attractiveness of the printing process, such as colored or flashing LEDs or incandescent lights, or other colored, variegated lights, in the form of back lighting, flooding the media surface or synchronizing the lights in various patterns to the spinning media 100. These may also be a portion of the imaging control system 460 electronics printed circuit board 630 (FIG. 6) or may be configured in separate circuitry.

Figure 5:
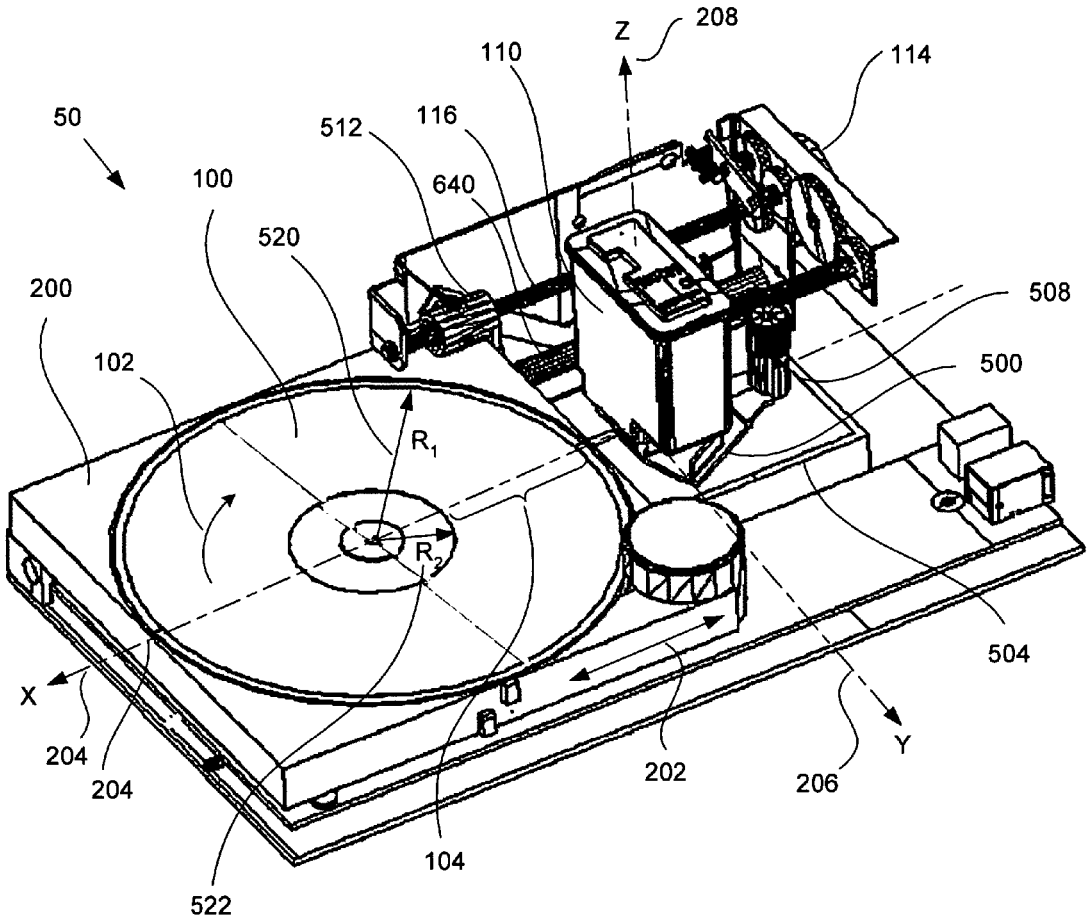
FIG. 5—Is a diagrammatic representation of aspects of an exemplary embodiment of the present invention, with the drive forward in the media loading position.

FIG. 5 is a diagrammatic representation of aspects of an exemplary radial sled printing system 50 in accordance with an embodiment of the present invention. FIG. 4~10 show that the print subsystem may be configured with several related components in radial sled printing system 50, including a print head 110, carriage assembly 448 and maintenance station 500, mounted in a stationary position for nozzles 120 to be substantially at or near origin 210 of coordinates x 204, y 206 and z 208 so as to allow media 100 to operably pass nearby the print head 110. The sled 200 may be a mechanism for supporting and transporting the spinning media 100 relative to the pen 110 and origin 210. In the exemplary configurations illustrated in FIG. 5~10, a print head 110 pen is located over a horizontally configured media 100; however, if the media spins in a vertical or in an inverted plane, then it may alternatively be placed in any orientation so as to hover relatively perpendicular to and in close proximity to the media 100 to affect printing. FIG. 7 shows the radial sled printing system 50 with the sled 200 positioned rearward where printing begins. As already described for FIG. 3~4 above, in one configuration to commence printing, the sled is pre-positioned to the rear-most sled location 22 along path 202 so as to be substantially under and in functional proximity to the print head 110 so as to enable and affect printing ink objects onto media 100. A plurality of nozzles 120 from print head 110 eject ink objects 450 (FIG. 4) onto media 100 to affect printing, as the sled 200 moves along x-axis 204 following path 202, guided along rod 640, actuated by sled nut 512, engaged by lead screw 116 and rotated by stepper motor 114. In other alternate embodiments of the present invention (not illustrated) the lead screw 116, sled nut 512 and stepper motor 114 may be operably configured in any combination of among the many widely available varieties of stepper, DC, ribbon or linear motors or linearly coupled actuators coupled to the sled via belts, gears, clasps, bearings, fasteners, pulleys, and optionally configured with motion control feedback components such as optical, mechanical, encoder, and appropriate grating patterns to adequately control the positioning of the sled along x-axis 204 with requisite precision in minute increments to ensure proper print quality.

A plurality of nozzles 120, for example as configured in the Lexmark 35 ink jet cartridge, may be optimally aligned in close proximity to, along or in one or more parallel rows to x-axis 204, preferably aligned along or parallel to the media 100 radius, as disclosed in U.S. patent application Ser. No. 10/159,729, now U.S. Pat. No. 6,786,563, issued Sep. 7, 2004, by Randy Q. Jones et al, and as disclosed in more detail in co-pending U.S. Provisional Patent Application No. 60/654,1638, filed Feb. 18, 2005, by Randy Quinn Jones et al, which applications are incorporated by reference herein. In one embodiment, specific groups of nozzles arranged by color, such as to cyan, magenta and yellow, respectively, are aligned in one row along the x-axis 204. In an alternate embodiment, a plurality of nozzles 120 may be similarly arrayed in parallel rows to the x-axis 204, such that color groupings of nozzles dedicated to cyan, magenta and yellow are aligned in a plurality of parallel rows to the x-axis 204 arrayed along the y-axis 206 yet in close proximity to origin 210, as disclosed by Randy Quinn Jones et al, a plurality of nozzles may be aligned and fired off-radial-axis yet provide radial printing while sled 200 traverses under the print head nozzles in a radial-wise fashion. Alternatively, nozzles 120 may be a plurality in any combination of colorants, top coating or ink receptive undercoating materials. For example, a stick-adhesive adaptive formulary coating may be applied from a plurality of nozzles to media 100 prior to applying ink colorants, thereby forming an ink-compatible printing surface on normally non-printable media, such as plain, unprintable-coated media. In this way, one set of nozzles could apply a foundation coating that adheres to the surface forming a receptive substrate, while another plurality of nozzles in the same or another print head 110 may apply colorants to form a printed image; one such method by way of illustration is disclosed in U.S. Pat. No. 6,854,841, by Unter, incorporated by reference herein. By way of another example, a clear coating may be applied from a plurality of nozzles to media 100 after colorants have been applied to form a protective or glossy coating.

Printing onto media 100 from print head 110 in accordance with the preferred embodiment begins at the inner radius $R_2$ 522 and moves to the outer radius $R_1$ 520 of the annular print area 104 along path 642, either while sled 200 is moving along path 202, continuously or in a plurality of steps of increasing-sized, overlapping or adjacently positioned concentric bands. Alternatively the printing may be accomplished by instead moving the sled 200 in the opposite direction to path 642, starting at the outer radius $R_1$ 520 and moving to the inner radius $R_2$ 522 of the annular print area 104 continuously or in a plurality of steps of decreasing-sized, overlapping or adjacently positioned concentric bands. In an alternative embodiment, radial sled printing system 50 may be configured with print head 110 to move along x-axis 204 and gradually increase the distance in the z-axis 208 relative to the surface of the media 100, while traversing between outer radius $R_1$ 520 and inner radius $R_2$ 522, such that print head 110 nozzles 120 may clear the top surface of hub 442. This configuration allows printing the media from edge to edge by overlapping the nozzles 120 with the hub 442. This may be useful for print heads 110 configured with radially aligned nozzles 120, such as the Lexmark 25 or Olivetti FJ-32 and XP-02 ink jet cartridges. These ink jet cartridge have a plurality of nozzles 110 grouped by color when aligned along the radius, with a first color initiating printing into a first concentric band on the innermost radius while a plurality of groups of nozzles overhang hub 442, awaiting for positioning over the innermost radius $R_2$ 522 to print. As the print head 110 moves outward to a second concentric band, a second group of nozzles will move into a first concentric band on the innermost radius $R_2$ 522. This process repeats through a plurality of bands until all nozzle groups have traversed to the outer radius $R_1$ 520 and affected completion of annular print area 104. While traversing the print head 110 gradually moves away from the media 100, which may normally distort ink drop placement; however, because the effective spin rate reduces relative to the media surface speed with respect to the point of ink drop placement at decreasing the radii print positions, image distortion is minimized on the more inner radii print positions. Similarly, the radial sled printing system 50 could alternatively print while traversing from the outer radius $R_1$ 520 to the innermost radius $R_2$ 522, achieving similar results.

Figure 6:
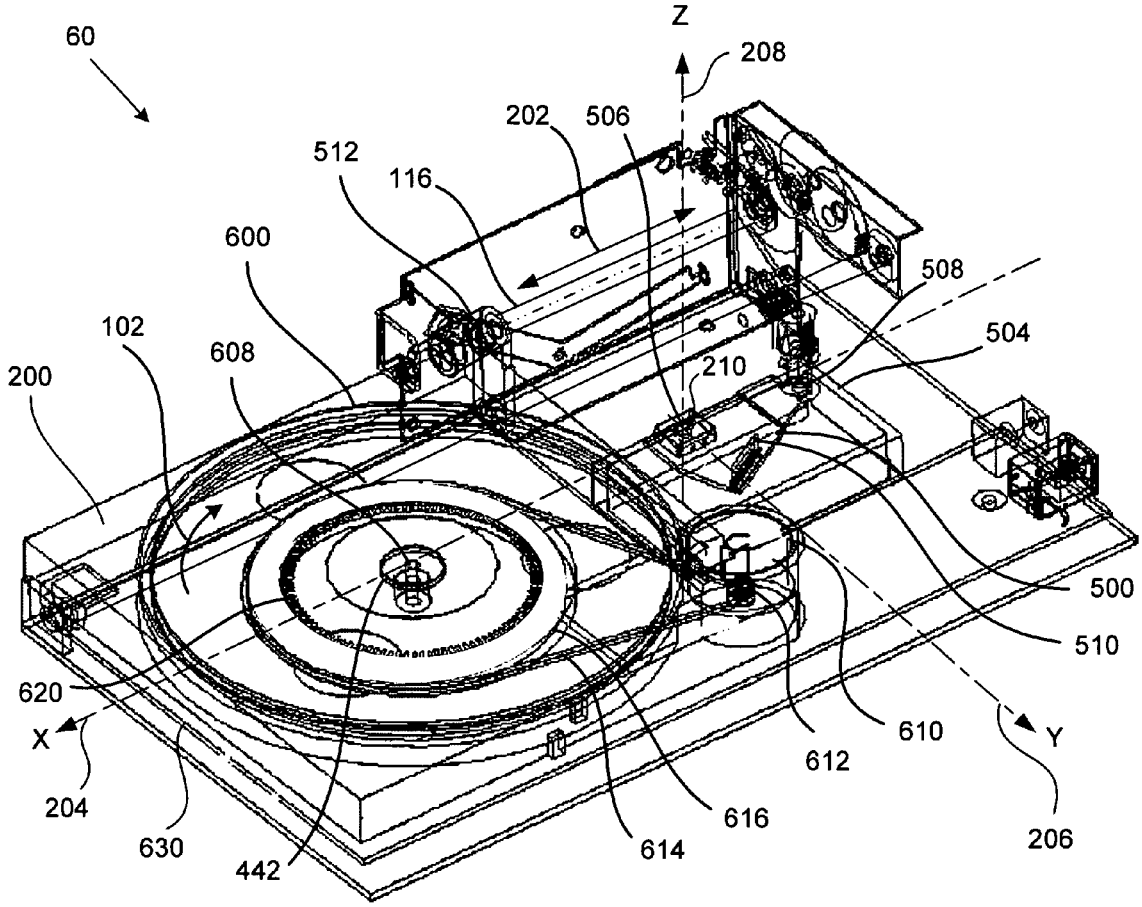
FIG. 6—Is a diagrammatic representation of aspects of an embodiment of a platter rotation mechanism of an embodiment of the present invention.
Figure 7:
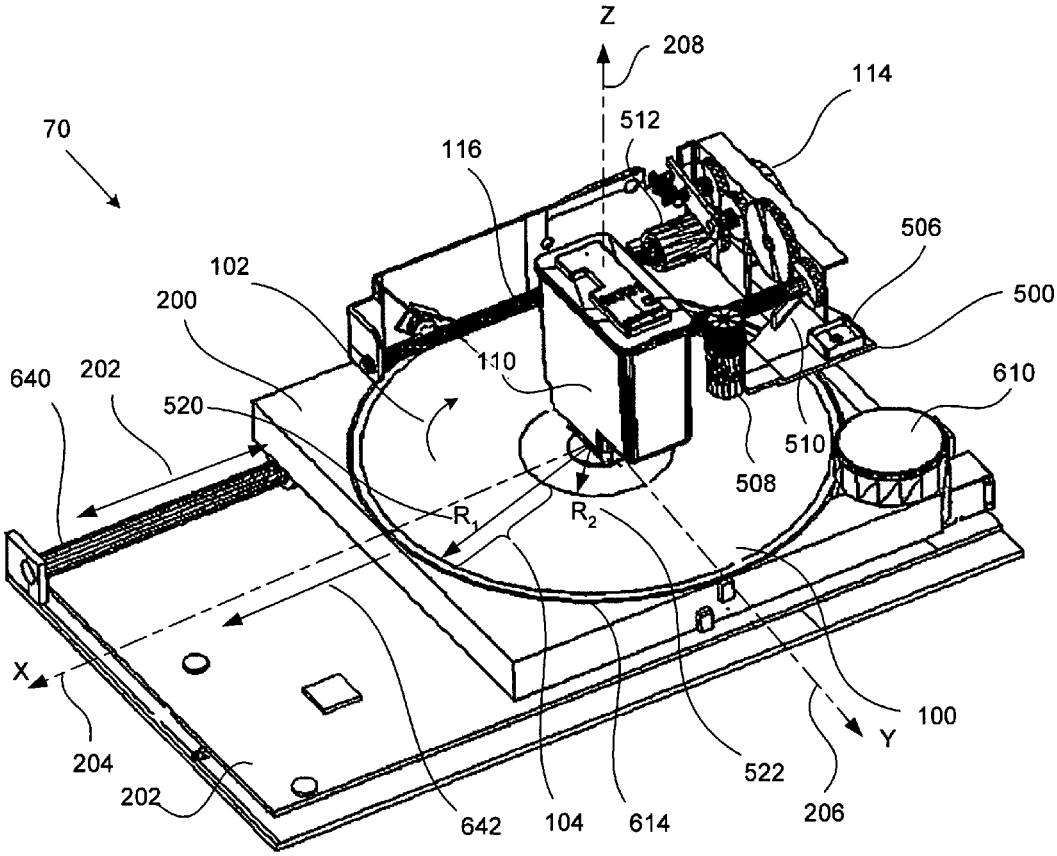
FIG. 7—Is a diagrammatic representation of a view of aspects of an embodiment of the present invention, with the sled rearward in the initial printing position under the print head.

FIG. 6 is a line drawing view of FIG. 5, detailing beneath the top surface of the sled and media spin-platter assembly. Platter 600 may be similarly sized as the media 100 (FIG. 5) and positioned and configured directly under the media so as to effectively hold and rotate the media. Platter 600 provides the supporting platform for holding and spinning the media 100 during printing. The platter 600 spins 102 by means of a motor 610 with motor spindle drive shaft concentrically affixed to motor platter drive pulley wheel 612, operably engaged with belt 614 which also loops around and operably engages with platter drive pulley wheel 616, to affect rotating around spindle shaft 608 in a clockwise or counter-clockwise fashion. Belt may alternatively be fashioned with teeth that operably engage with mating toothed motor 612 and pulley wheel 616. The belt 614 may be made of rubber or a non-stretch material, such as polyurethane, reinforced by nylon or Kevlar® or any other suitable material. Alternatively, the motor 610 may be configured to mount directly onto or as an integral part of the axel of the platter spindle shaft 608. For an ink jet print head configuration of the radial sled printer, the motor may be a DC or any other suitable motor capable of spinning smoothly at a rate to enable printing radially with minimal ink distortions. A phase-lock loop (PLL) may be used to more precisely govern the motor spin-rate uniformity, to minimize wow and flutter on the spindle motor 610.

Figure 19:
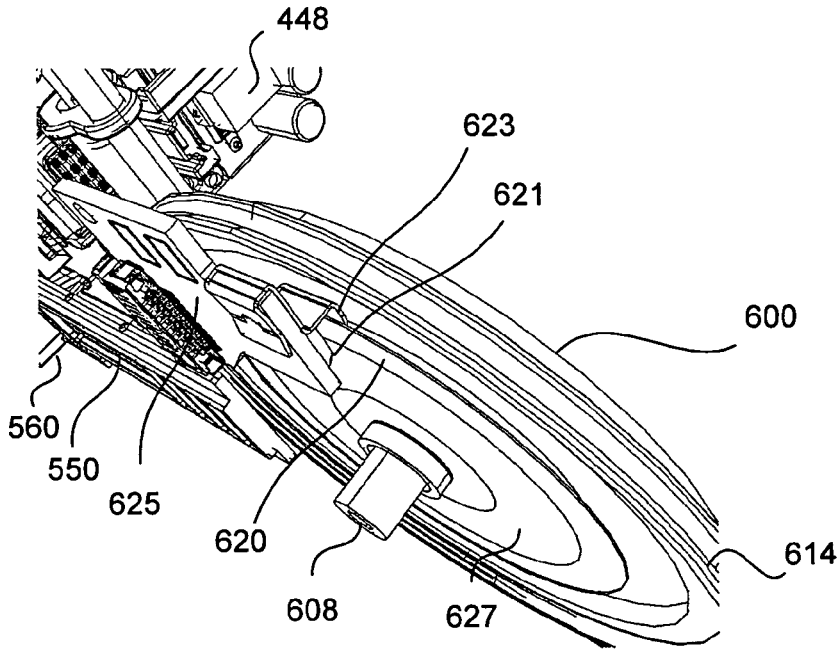
FIG. 19—Is a diagrammatic representation of aspects of the embodiment of FIG. 13 showing a more detailed view of the encoder and codewheel configuration under the platter.

Platter 600 may be fashioned from molded plastics, metal or any suitably rigid, balanced material of sufficient mass to spin reliably. It may be embossed with an encoding grating pattern 620 concentric to and at any optimal radius from the platter spindle shaft 608, positioned on the bottom of the platter surface (FIG. 19) such that an encoder sensor 621 may be mounted underneath, on circuit board 630 so as to align upward and operably couple with the encoding pattern 620. In an alternative embodiment, the encoding pattern may be a separate code wheel 627 with gratings 630 mounted concentrically on the platter shaft under the platter 600 within operable orientation to the encoder sensor 621 and main circuit board 630 or on another circuit board 925, separately mounted from circuit board 630, as disclosed in U.S. patent application Ser. No. 10/127,948 by Youngberg et al, incorporated herein by reference. For ease of installation, reliability and alignment, encoder sensor 621 may be Agilent part no. AEDR-8300-1P0, a reflective encoder mounted on the surface of PCB 625, with encoder mirror clip 623 made from materials with specular reflectivity of 85% or greater, positioned above and substantially parallel to codewheel 627, as shown in FIG. 19. Encoding pattern 620 may be configured to have counts of at least 120 counts per revolution, extrapolated to higher resolutions by use of PLL circuitry previously referenced; encoding pattern counts of 400-900 counts per revolution are more preferably for assure better radial sled print quality, as empirically derived in our laboratory. FIG. 7 shows sled 200 relocated from the media loading position shown in FIG. 5 to a position where printing begins, pre-positioned to the rear-most sled location along path 202 so as to be substantially under and in functional proximity to print ink objects from the print head 110 onto media 100. A plurality of nozzles 120 (FIG. 2) from print head 110 eject ink objects onto media 100 to affect printing, as the sled 200 precesses forward along path 202 (FIG. 5~7) along glide rod 640, actuated by sled nut 512, engaged by lead screw 116 and rotated by stepper motor 114. Printing onto media 100 from print head 110 in accordance with the preferred embodiment begins at the inner radius $R_2$ 522 and moves to the outer radius $R_1$ 520 of the annular print area 104 along path 642, either while sled 200 is moving along path 202, continuously or in a plurality of steps of increasing-sized, overlapping or adjacently positioned concentric bands. Alternatively, in accordance with another embodiment, printing may be accomplished by moving the sled 200 in the opposite direction to path 642, starting instead at the outer radius $R_1$ 520 and moving to the inner radius $R_2$ 522 of the annular print area 104 continuously or in a plurality of steps of decreasing-sized, overlapping or adjacently positioned concentric bands. Alternate embodiments may also include additional glide rods such as on the opposite side of the sled thereby providing increased stability and precision in the travel of the sled as well as other advantages.

Figure 9:
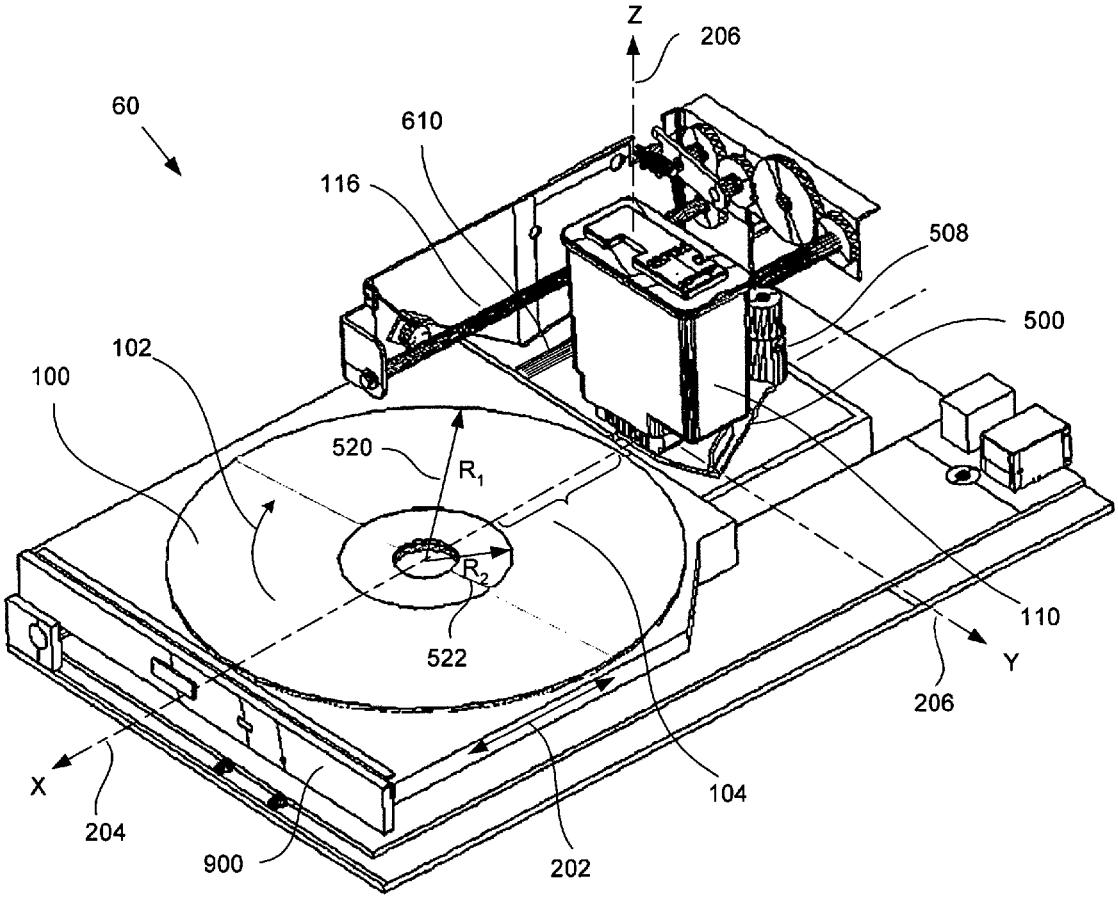
FIG. 9—Is a diagrammatic representation of an alternative view of aspects of an embodiment of the present invention using a slimline CD/DVD recordable drive as the radial sled, with the drive (sled) positioned forward at the media loading area.
Figure 10:
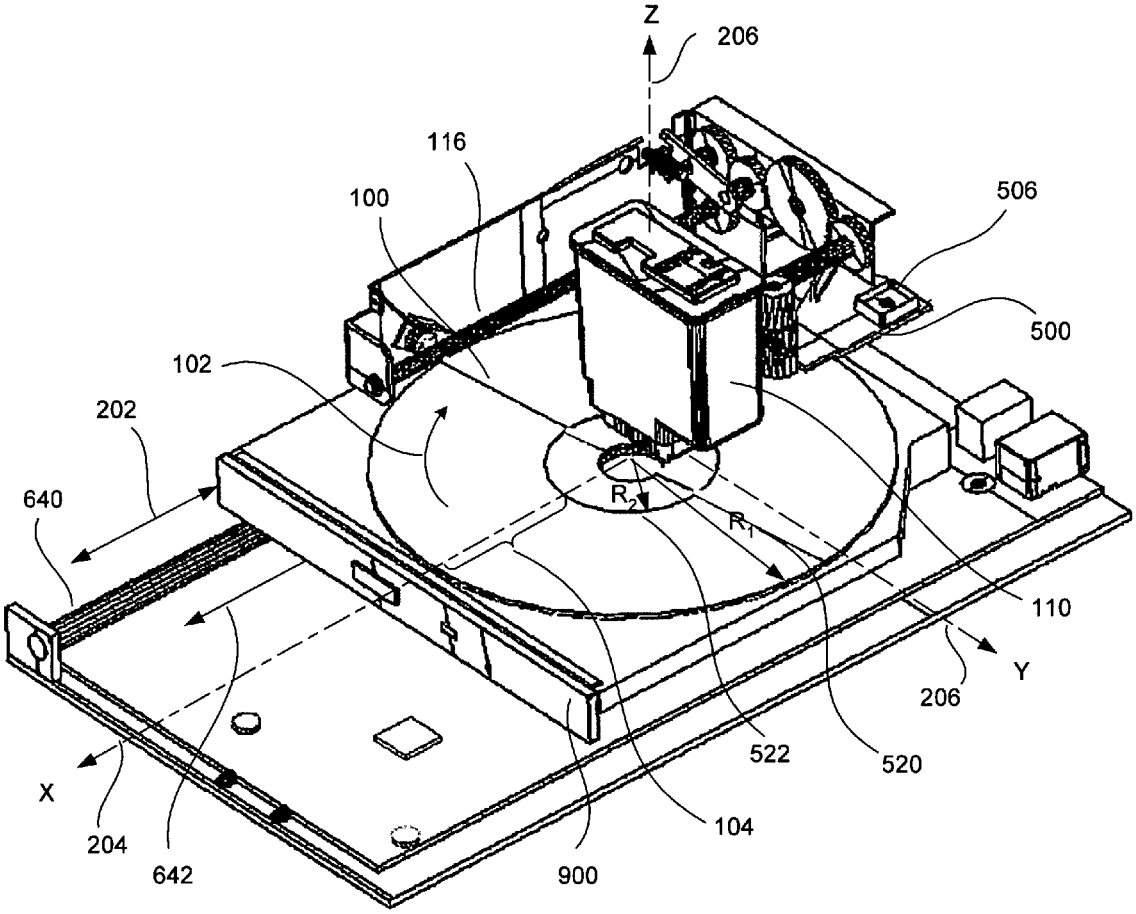
FIG. 10—Is a diagrammatic representation of a view of aspects of another embodiment of the present invention using a slimline CD/DVD recordable drive as the sled, with the sled (slimline drive) rearward in the initial printing position under the print head.

Alternatively the platter may be configured to spin faster, either by means of the radial sled printer embodiment of FIG. 5~7 or by means of the slimline CD/DVD recordable drive motor embodiment of FIG. 9~10. For the radial sled printer embodiment of FIG. 5~7, DC motor 610 may spin at higher rates up to the limits of the structural integrity of the media (typically 10,000 RPM or more) for other non-ink jet, non-contact print head technologies. Similarly, printing at the highest-recording spin rates (typically 24×-52× for CDs) can be achieved using the CD or DVD drive's spindle motor. The CD or DVD drive configuration using full-rated drive speed is highly beneficial because it enables printing the media surface simultaneously while recording the media at its full-rated recording speed. This configuration is such that no additional starting or stopping for media insertion, media flipping or even print time is required to print the label while simultaneously recording.

In another embodiment of the present invention, the aforementioned non-contact print head technology may be any light source, laser, ultrasonic, microwave, thermal irradiant emitter or any other energy source capable of being directed or focused to sufficient accuracy to affect an image on the printable surface, as disclosed in U.S. Pat. No. 6,736,475 by Bradshaw et al, incorporated herein by reference. Media may be suitably coated with a receptive surface that is reactive to the specific energy stimulation source, changing color or producing an image there from, such as thermal-chromic coating stimulated by a laser, thermally reactant coating by infrared heat, or photo sensitive to a specific spectral wavelength such as a plurality of light emitting diodes, an LCD strip mounted along the radius, light bar or to selectively irradiate a light-initiated surface, such as photo sensitive, microencapsulated ink objects.

Figure 8:
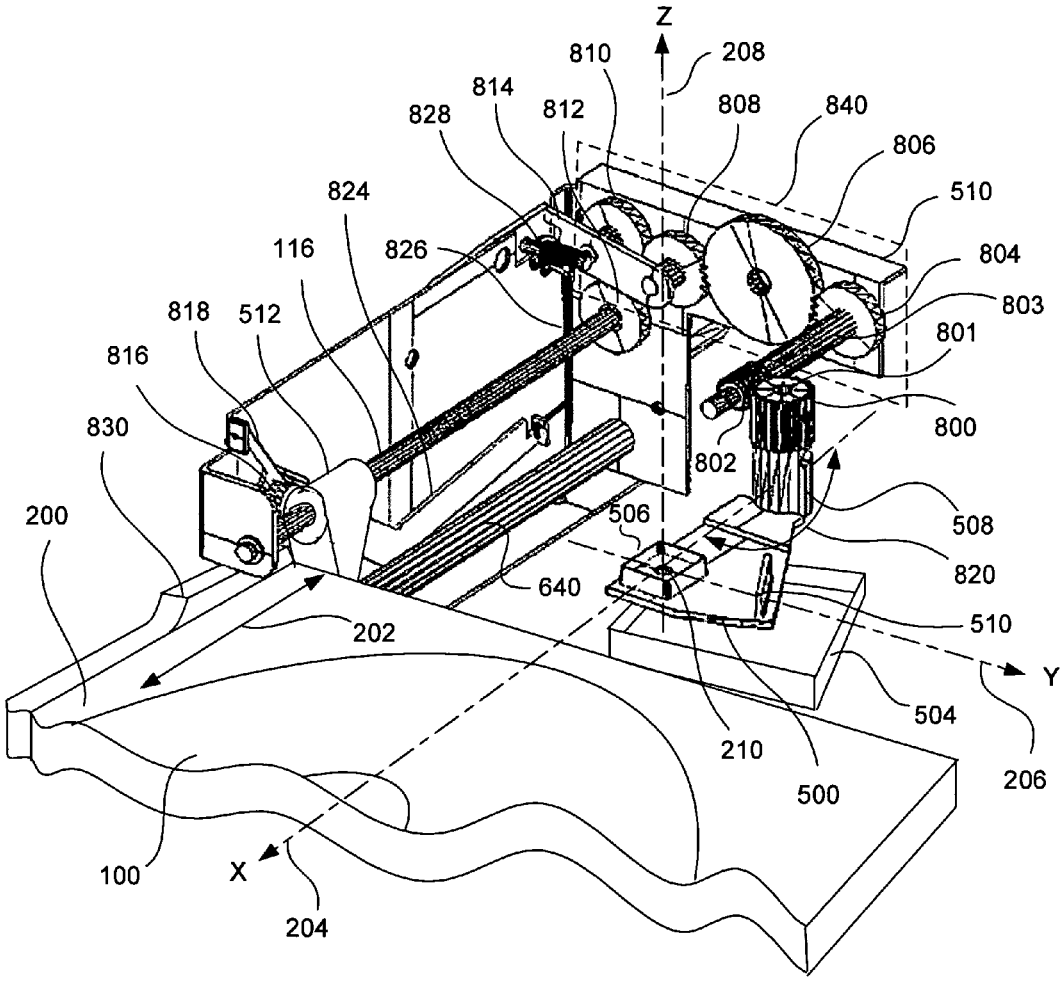
FIG. 8—Is a diagrammatic representation of aspects of an embodiment of the present invention illustrating a rotary pen maintenance station actuated by radial sled motion.

FIG. 8 depicts a cut-away portion view of the radial sled printer in accordance with an embodiment of the present invention, illustrating an exemplary rotary ink jet pen maintenance station 500~510. In an embodiment of the present invention configured with a print head 110 comprising an ink jet print head 110, the print head 110 must be maintained by spitting, wiping and capping a plurality of print head nozzles 120 to prevent them from drying out or clogging. Ink jet print head maintenance provides essential servicing of the print head during printing and for maintenance and storage once printing has completed.

Figure 11A:
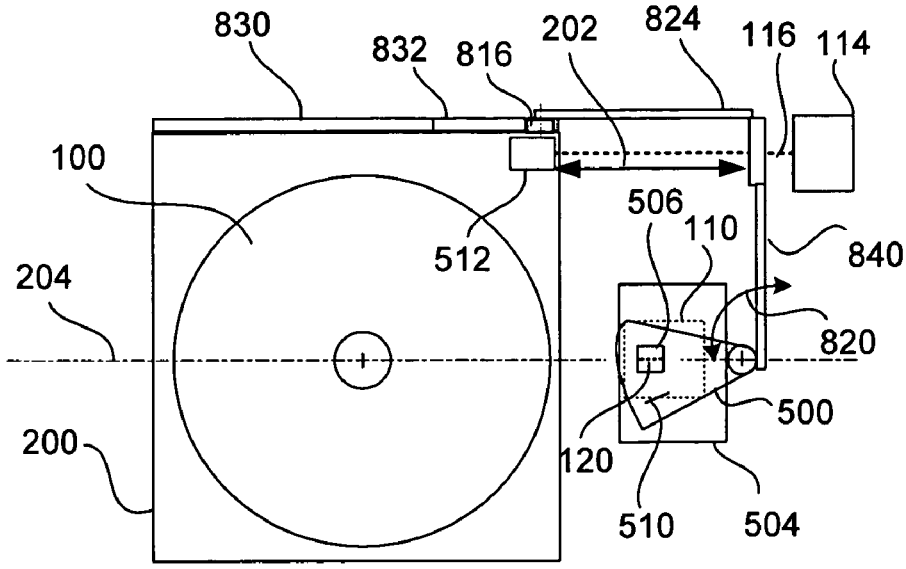
FIGS. 11*a*~11*d*—Are diagrammatic representations of four process stages of the print head maintenance arm while radial sled printing in an embodiment of the present invention.

Now the rearward sled motion profile will be explained in more detail. Referring to FIG. 5~8 and FIG. 11, ink jet print head maintenance may be accomplished in the preferred embodiment by a maintenance arm 500 rotating into or out from a position under the print head 110 at the origin 210 while cycling through four positions of sled motion as follows:

(1) FIG. 11*a* illustrates the media loading position, wherein the maintenance arm 500 is fully rotated forward into a position whereby the print head is capped as shown in FIG. 5 and FIG. 8~9. Approximate portions of print head cap 506 and wiper 510 may be fashioned from pliant rubbery material as specified by the print head manufacturer.

Figure 11B:
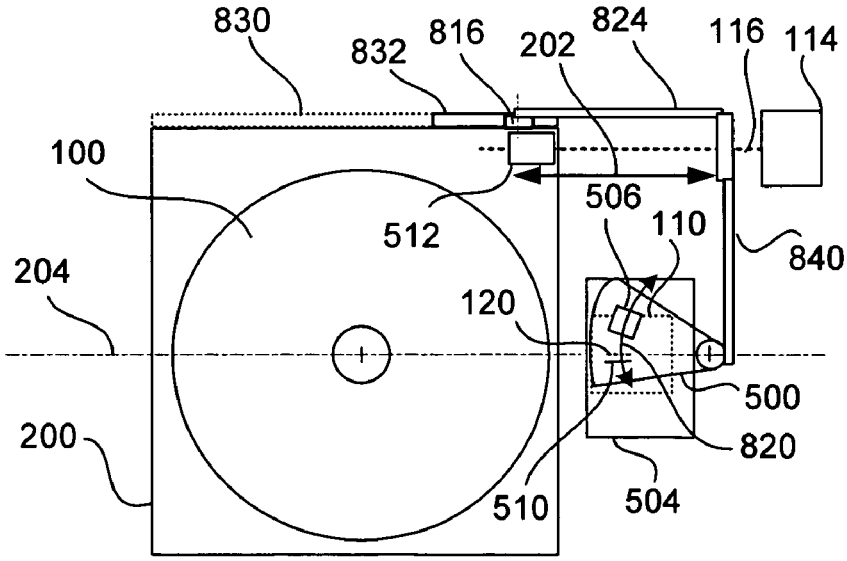

(2) FIG. 11*b* illustrates the print head wiping phase, wherein the sled 200 is moving partially rearward and wiper 510 rotates so as to wipe the bottom surface of the print head nozzles 120 as said wiper rotates through the origin 210 area. Alternatively the sled 200 may be configured to partially move a plurality of times forward and rearward to repeat wiping actions.

Alternatively, maintenance arm 500 sequencing can be established so that wiper 510 can repeatedly wipe the bottom surface of the print head nozzles 120 independently of separate movement of sled 200.

Figure 11C:
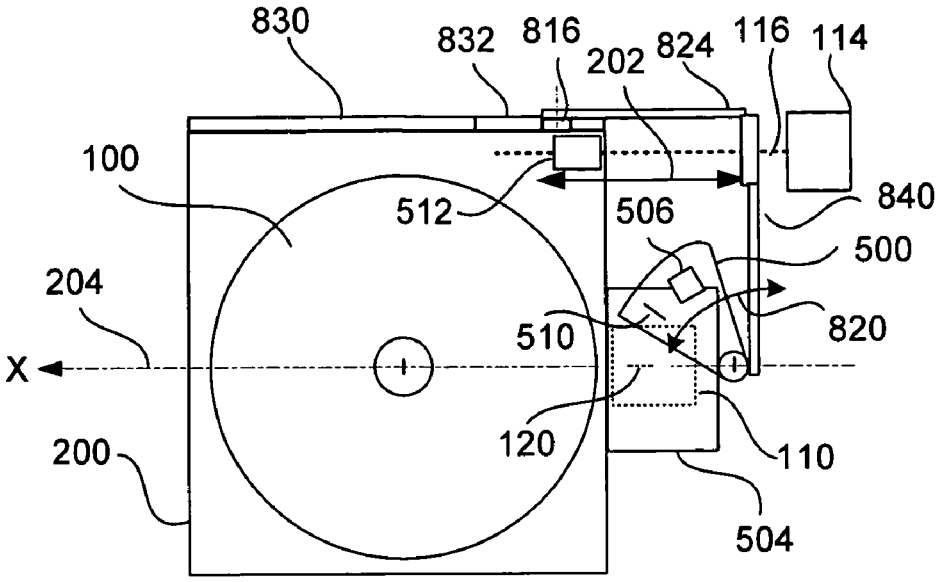

(3) FIG. 11*c* illustrates the print head spitting phase, wherein maintenance arm 500 rotates to expose the spit station directly under print head origin 210 area, thus permitting unimpeded firing of a plurality of ink objects 450 into spittoon 504 thus affecting cleaning or clearing a plurality of print head nozzles 120. Spittoon 504 may be configured with suitable absorbent materials, with optional sidewalls or covers to help contain ink overspray.

(4) FIG. 1*d* illustrates the printing position wherein the sled 200 is in the initial printing position and begins traversal under the print head while printing and the maintenance arm 500 swings out of the way so as to not obstruct the sled 200 motion. For example, FIG. 7 shows an embodiment wherein the maintenance arm 500 from the top perspective has been retracted clockwise and rotated rearward approximately 180 degrees from the origin, such that print head cap 506 is positioned rearward.

In alternate embodiments, the maintenance bay can move in a direction perpendicular or parallel to the movement of sled 200 (as compared to rotating around an exis as does maintenance arm 500) and still accomplish the purposes of storing, wiping, spitting and cleaning of the print head.

Referring to FIG. 2, 5~8 and 11, an explanation of the sled motion process as it actuates the maintenance arm 500 will now be detailed for the embodiments depicted. Sled 200 traverses between loading position 20 (similarly see 50, FIG. 5) and rear print position 22 (similarly see 70, FIG. 7) along x-axis 204, and activates the maintenance arm 500 rotation process sequence detailed in FIG. 11*a*~11*d*. Sled 200 may be configured with side rail 830 with cam bump 832 to profile, sequence and synchronize the maintenance arm 500 rotation to the sled's linear displacement 202 along x-axis 204. Motor 114 turns lead screw 116 and as well as lead screw drive gear 812, determining the direction of rotation of maintenance arm 500. Sled nut 512 may be attached to sled 200 and drives sled motion as actuated by lead screw 116 and motor 114. As sled 200 moves, pressure from tension spring 818 forces roller 816 to track against side railing 830 and follow cam bump 832 contour during a portion of the sled movement. Roller 816 is affixed to and operably engaged with rocker arm 824 and link 826, interconnecting with clutch arm 814. Clutch arm 814 operably engages or disengages the clutch gear 810 with lead screw drive gear 812, transferring power from motor 114 throughout drive transfer mechanism 840 (gear train 800~810), resulting in maintenance arm 500 rotating through motion 820. When roller 816 is not traversing the cam bump, the clutch gear 810 is disengaged and the maintenance arm 500 is still; conversely, when roller 816 is traversing the cam bump, the clutch gear is engaged and the maintenance arm 500 rotates clockwise.

Now the forward sled motion profile will be explained in more detail by the sequence of views of the illustrations, transitioning from FIG. 11*d*, 11*c*, 11*b*, to 11*a*, respectively. Drive transfer mechanism 840 in accordance with an embodiment of the present invention more specifically may consist of actuation gear 810, driving idler gear 808, which drives transfer gear 806, which drives worm axle gear 804, which turns worm gear 802 and ultimately turns cam gear 800, rotating print head maintenance arm 500. In alternate configurations, transfer gear 806, idler gear 808 and worm axle gear 804, may be a belt between two pulleys, a rack and pinion gear, pulleys and retractable string or any other suitable mechanical or electromechanical means to transfer power and thereby motion from the lead screw drive shaft into rotation of the print head maintenance arm 500. The specific contour and length of cam bump 832 determines the duration and angular displacement of the print head maintenance arm's 500 rotation as sled 200 moves along roller 816. In the exemplary configuration shown in FIG. 8, the cam may be configured in length of 0.48 inches, such that the maintenance arm 500 rotates 180 degrees as sled 200 moves the first 0.48 inches.

After moving sled 200 into furthest rearward print position, motor 114 is reversed either during continuous printing or while stepping and printing concentric bands. Referring to FIG. 8 to detail the arm motion, while sled is translating forward 642 (FIG. 7), roller 816 is tracking over side rail 830 until meeting the returning cam 832 contour; this initiates retraction of the maintenance arm 500 back into position under the print head 110. Motor 114 turns lead screw 116 in a reverse direction as well as lead screw drive gear 812. Sled nut 512 as attached to sled 200 drives sled motion forward. As sled 200 moves, pressure from tension spring 818 forces roller 816 to track against side railing 830 and follow cam bump 832 contour during a later portion of the sled movement. Roller 816 is affixed to and operably engaged with rocker arm 824 and link 826, interconnecting with clutch arm 814. Clutch arm 814 operably engages or disengages the clutch gear 810 with lead screw drive gear 812, transferring power from motor 114 throughout drive transfer mechanism 840 (gear train 800~810), resulting in maintenance arm 500 rotating through motion 820. When roller 816 is not traversing the cam bump, the clutch gear 810 is disengaged and the maintenance arm 500 is still; conversely, when roller 816 is traversing the cam bump, the clutch gear is engaged and the maintenance arm 500 rotates counterclockwise though the series processes in the sequence illustrated in FIG. 11*d*, FIG. 11*c*, FIG. 11*b*, and FIG. 11*a*, wherein printing is completed, spitting is performed, wiping is performed and the print head is recapped, respectively. In alternative embodiment, the maintenance arm 500 may be configured to alternatively rotate backward counterclockwise and return to the capping position by rotating clockwise. In another alternative embodiment of the present invention the maintenance arm 500 may be configured to operably slide upward and to the side of origin 210. In yet another alternative embodiment of the present invention the maintenance arm may be configured to operably swing and lift upward so as to not impede the rearward motion of sled 200, then return to wipe and cap print head 110.

Figure 11D:
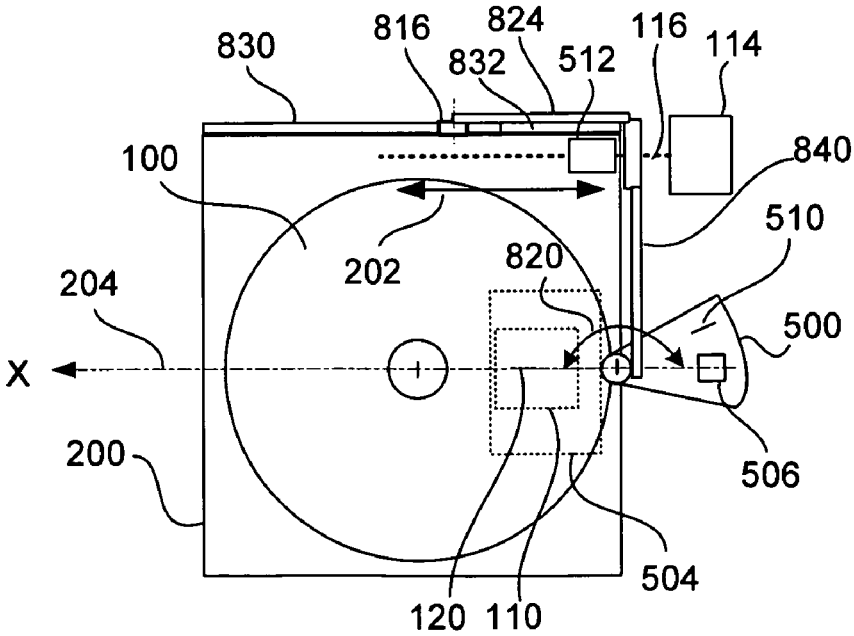

In both aforementioned rearward and forward sled motion profiles, maintenance arm 500 cam 508 mounted on shaft 801 (FIG. 8) serves to raise or lower the print head wiper 510 and print head capping seal 506 during certain aspects of the maintenance arm 500 rotation. The cam 508 may be configured with a contour to lower the print head wiper 510 and print head capping seal 506 when during printing as shown in FIG. 11*d*, while also raise the print head wiper 510 and print head capping seal 506 when preparing the print head for storage by for wiping (FIG. 11*b*) and capping (FIG. 11*a*).

In an alternate embodiment of the present invention, shown in FIG. 13~19, the maintenance arm 500 may be slideably configured to collapse telescopically into the sled base as the sled moves rearward, reducing overall length of the apparatus. Maintenance arm 500 (FIG. 15) may be configured as a slide 550 and caboose 560 (FIG. 17~18) containing a plurality of print head maintenance station components, such as the wiper, spit station (spittoon) or nozzle cap. During operation caboose 560 functions as a follower mechanism to sled 200 on roller bearing wheel 552 (FIG. 15~17), such that caboose 560 is slideably connected to sled 200 via slide 550. In one aspect of the present invention, a plurality of caboose 560 components operably move substantially aligned parallel with respect to the sled 200 motion along the direction of the x-axis 204 and substantially aligned vertically with a media's 100 surface and print head 110 nozzle array 120. Similar to the aforementioned rearward and forward sled motion profiles in the present invention, as imaging control system 460 (FIG. 4) moves sled 200 rearward in the negative x-axis 204 direction, sled 200 moves along guide rods 660 and the ink jet nozzle cap 506 lowers from nozzle array 120 via spring 554

Figure 15A:
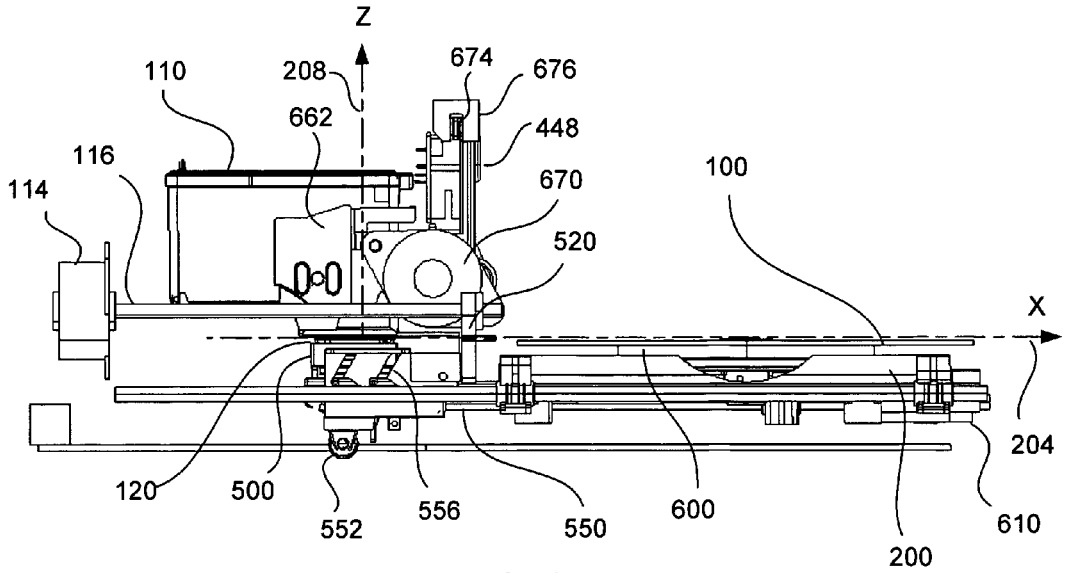
FIGS. 15*a*~15*b*—Are diagrammatic representations of aspects of the embodiment of FIG. 13 showing side and bottom views.
Figure 15B:
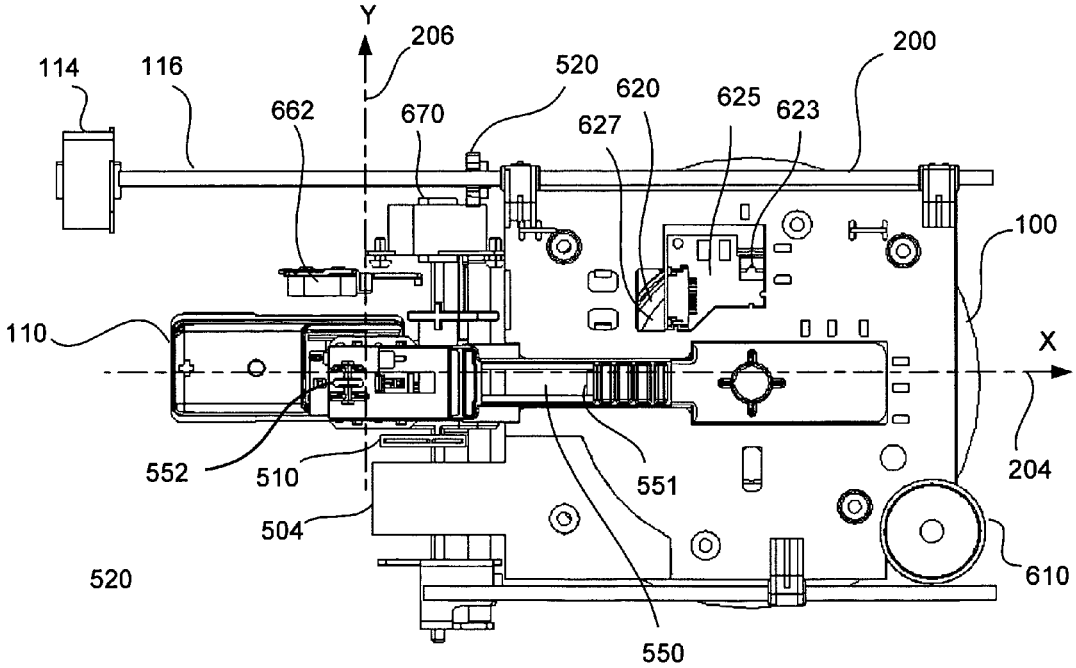
Figure 16:
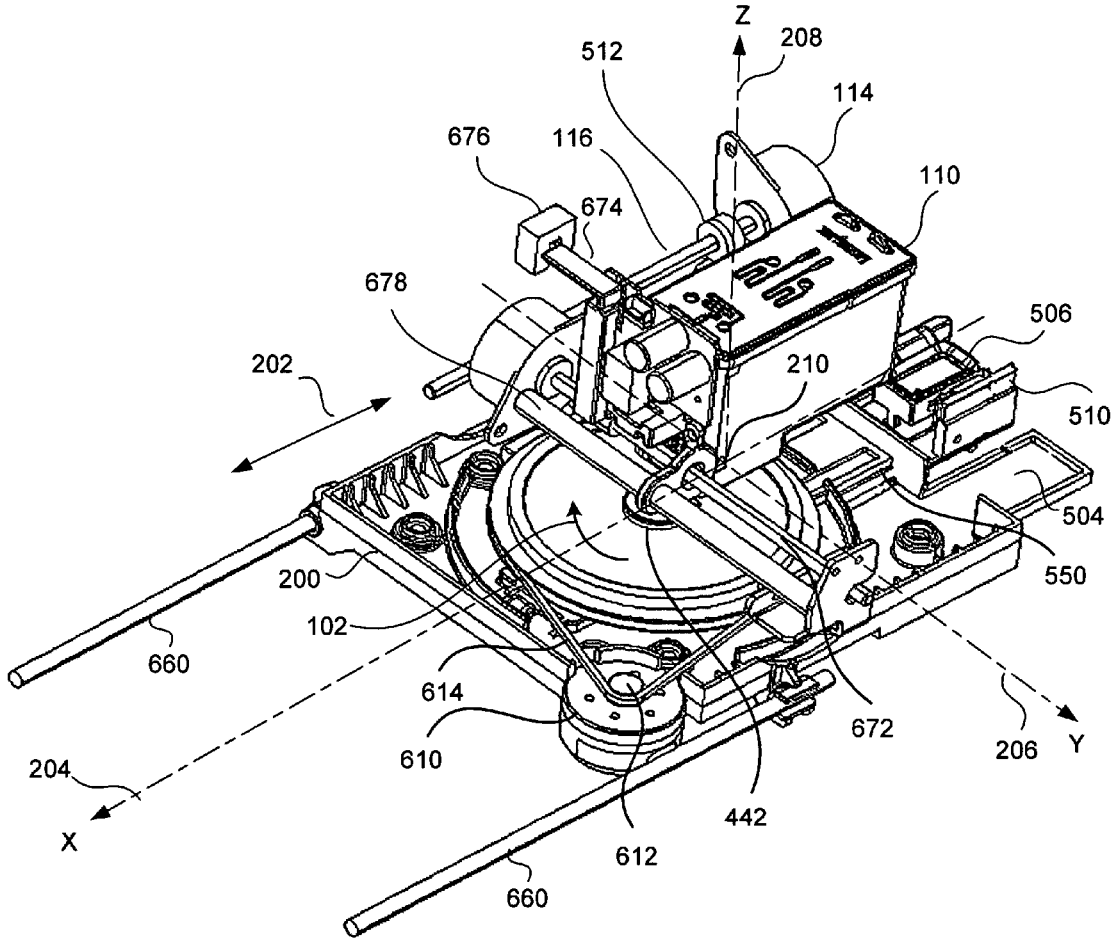
FIG. 16—Is a diagrammatic representation of aspects of an embodiment of the present invention configured for off-radius-axis positioning of the print head and slideable caboose maintenance station with sled in rearward position.
Figure 17A:
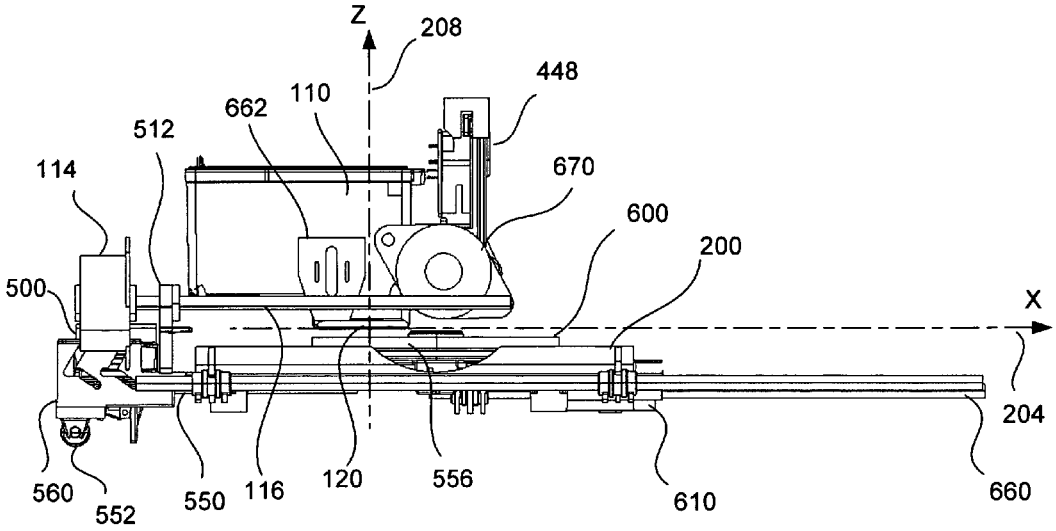
FIGS. 17*a*~17*b*—Are diagrammatic representations of aspects of embodiments of FIGS. 13~16 showing a more detailed view of the caboose maintenance station.
Figure 17B:
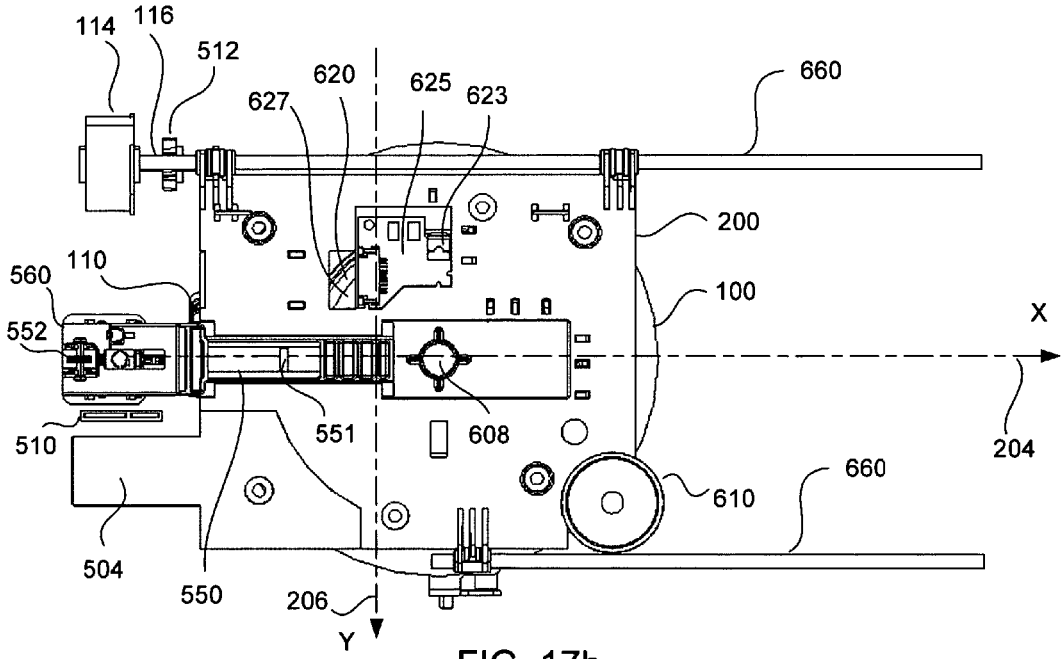
Figure 18:
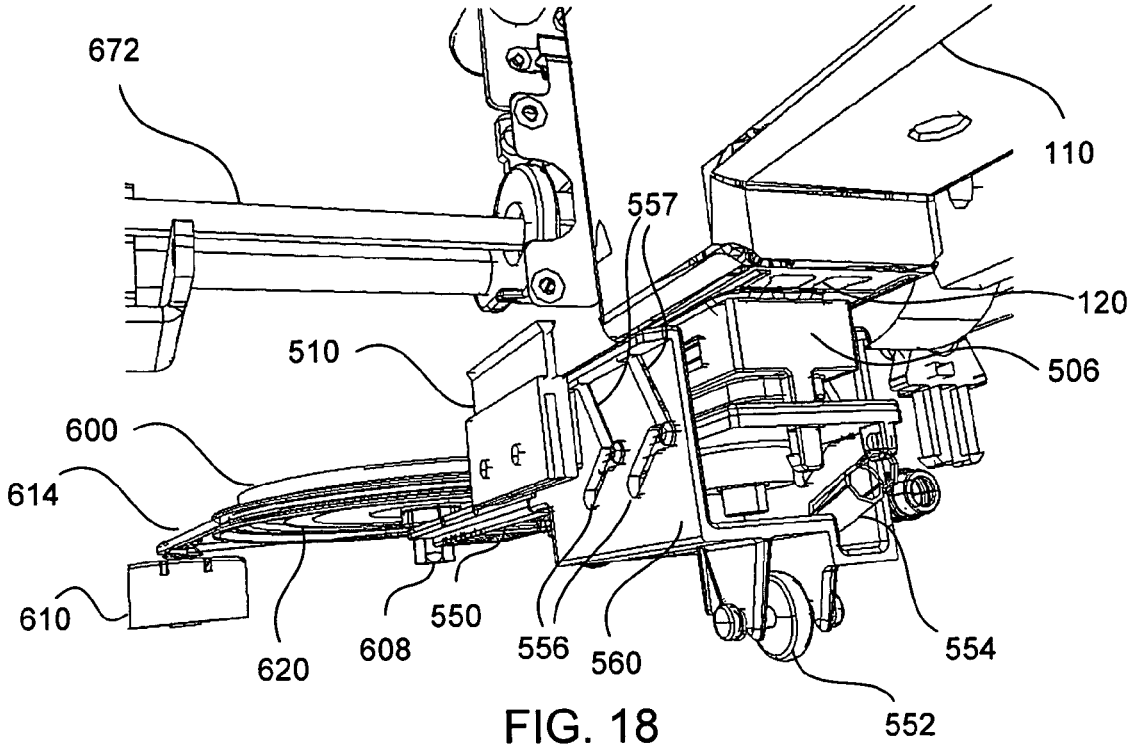
FIG. 18—Is a diagrammatic representation of aspects of embodiments of FIGS. 13~16 showing a more detailed view of the caboose maintenance station.

(FIG. 17*a*) while guided along slots 556 (FIGS. 15*a* and 17*b*) as slide 550 begins telescoping into sled base 200 along guide 550 (FIG. 15*b*).

In one configuration of the present invention wipe 510 is attached to sled 200. In one method in this configuration, after the uncapping the nozzles 120 imaging control system 460 may operably move print head 110 along y-axis 206 on rod 678, by means of stepper motor 670 and lead screw 672, past wiper 510 to spittoon 504, for inkjet spitting and cleaning. Motor 670 may also be configured as a DC motor, configured with a cam, belt and pulleys, gears or other motion coupling to the print head 110. Position of print head 110 may be determined by counts on stepper motor 670 or by an encoder strip running though an encoder mounted on print head controller board 442. Flag 674 may be configured with sensor 676 to mark a home reference for the y-axis motion. Sensor 676 may be a Fairchild H22, or any optical, microswitch, proximity or other suitable contact or non-contacting sensor.

In an alternative method in this configuration of the present invention, imaging control system 460 (FIG. 4) may first jog sled 200 rearward such that that wiper 510 moves along x-axis 204 beyond a point of print head 110 interference, to wipe the nozzles along the opposite direction if required for proper nozzle 120 cleaning; whereupon, print head 110 moves along y-axis 206 directly to spittoon 504 to clean the nozzles 120 and thereafter sled 200 is moved forward along x-axis 204 to place wiper 510 in a position of interference with the print head 110 reverse motion along the y-axis 206, thus affecting opposite-direction wiping.

Next in the present method, imaging control system 460 moves print head 110 along y-axis 206 into optimal print position, typically in the vicinity of, but off-axis to, the radial line along x-axis 204 with respect to media 100, as disclosed in co-pending U.S. Patent Application No. 60/654,1638 by Randy Quinn Jones et al, incorporated herein by reference. As imaging control system 460 moves sled 200 forward along x-axis 204, sensor 662 media 100 will traverse under sensor 662 and allow imaging control system 460 to take measurements, which may be used to determine if media 100 is present prior to printing. Sensor 662 may be a grayscale media sensor available from LiteOn of Taiwan, or STMicrosystems of Geneva, Switzerland, and may also be used by the imaging control system 460 to determine the size difference between 8 cm and 12 cm media, as well as may be used to determine whether the media is printable. Sensor 662 may also be used to calibrate the ink usage to the media type, through a series of algorithms in imaging control system. Imaging control system 460 may alternately move sled 200 along x-axis 204 rearward (in the negative x-axis direction) into the initial print position, in tandem operably pushing caboose 560 backward in the negative x-axis direction, collapsing telescopically slide 550 into sled 200, thus shortening the overall length of the apparatus. While printing, imaging control system 460 spins platter 600 and consecutively moves the sled 200 in a forward, positive x-axis 204 direction, while firing print head 120 nozzles 120 to eject ink, timed according to encoder 610 and codewheel 620 attached to spindle shaft 608, similar to the methods in the previously described preferred embodiment.

As imaging control system 460 moves sled 200 forward along x-axis 204, caboose 560 follows forward along until tab 550 (FIG. 17*b*) meets a mechanical stop (not illustrated) in the base located just in front of roller bearing wheel 552, initiating the slide 550 extension, which extension halts when slide slot tab 551 reaches a mechanical limit, whereupon cap 506 is forced upward along slots 556. Just prior to this step, imaging control system 460 moves print head 110 along y-axis 206 into position over spittoon 504, fires nozzles 120 for cleaning and finally moves print head 110 further along y-axis 206 into position over nozzle cap 506; whereupon imaging control system 460 ends the print job by moving sled 200 into the unload position while cap 506 is forced upward along slots 556 to seal nozzles 120. In an alternative method in this configuration of the present invention, prior to finalizing the print job, imaging control system 460 may first jog sled 200 rearward such that that wiper 510 moves along x-axis 204 beyond a point of print head 110 interference, to wipe the nozzles 120 for cleaning; whereupon, print head 110 moves along y-axis 206 directly to spittoon 504 to clean the nozzles 120 and thereafter sled 200 is move forward along x-axis 204 to place wiper 510 in a position of interference with the print head 110 reverse motion along the y-axis 206, prior to finally moving forward to cap 506 the nozzles 120.

Combination Radial Sled Printer and CD/DVD Recorder

FIG. 9~10 illustrates yet another alternate embodiment of the present invention, where slimline recordable DVD drives or similar shaped models (approximately 128 mm wide and deep and 8 mm high) such as models DV-W24 or DV-W28 from Teac America, Inc., of Montebello, Calif., and may be configured for operable use as a radial sled, functionally similar to the sled 200 used in FIG. 5~8 and FIG. 11. As such, the drive 900 rotates the media 100 while being moved along a path 202 parallel to and along a radial centerline 204 of the media. Referring to FIG. 9, drive 900 functions synonymously to the sled 200 in FIG. 5, to affect movement into initial position for printing as shown in FIG. 10, similar to FIG. 7 and with respect to all maintenance arm positions depicted in FIG. 11. Drive 900 may also function similarly to sled 200 as the maintenance arm 500 sequencer, as shown in FIG. 8, when configured with side rail 830 and cam 832 (FIG. 11), attached to the side of drive 900. Drive 900 similarly may be configured with nut 512 attached to the drive to operably engage the drive to lead screw 116 and motor 114.

An alternative element of system diagram shown in FIG. 4, the ATAPI drive interface 450, is essential when adding drive 900 to the system in place of sled 200. Drive interface 450 may be configured for ATAPI, Serial ATA, SCSI, or any such type as typically configured for CD or DVD drives. The drive interface 450 may be a discrete ATAPI bridge; for example, an FX2 USB-to-ATAPI bridge device having part number CY7C68013 from Cypress Semiconductor of San Jose, Calif. Alternatively the drive interface 450 may be incorporated and configured into control logic 420 or into an SoC logic chip comprising component in 462 (FIG. 4).

In another embodiment of the present invention with a CD/DVD drive configured, drive 900 differs from sled 200, in that it is a functional CD or DVD recorder and as such can record data on the reverse printing side of media 100. As a wholly encapsulated subsystem, drive 900 may be configured as an integral part of a system to record and print the media in a single disc insertion into the radial sled printing system. This desirable configuration combines printing and recording into one device. In an embodiment configured with Teac drive models, as well as with most other recent brands and models, during normal read-write operations, the drives are incapable of spinning more slowly than a 4× CD spin rate, or approximately 1200-1600 RPM. However, Teac drive models may be configured with firmware modified to spin at approximately 500 RPM or less constant angular velocity (CAV) to reduce print distortions, as previously referenced and disclosed in U.S. Pat. No. 6,264,295, by Bradshaw et al, incorporated by reference herein. Bradshaw et al disclosed that slowing spin rate RPM reduces twisting distortion (Col. 15-16). When using inkjet print heads, slowing spin rate RPM also reduces satellite tails and radial ink-dot migration at higher media 100 spin rates, as previously referenced and disclosed in U.S. patent application Ser. No. 10/125,777, now U.S. Pat. No. 6,854,841 by Unter, incorporated by reference herein. Applying the present methods has been empirically demonstrated to show that printing using ink jet print heads at 500 RPM or less produces acceptable image quality.

A further design constraint for both radial and radial sled printing is that a typical print head using ink jet print heads can only fire nozzles at a continuous frequency of 6-12 kHz. This creates a limitation for firing ink print head nozzles contiguously in one rotation, as the instantaneous annular velocity at the point of incidence of the jetting ink exceeds normal surface velocity limits, as previously referenced and disclosed in co-pending U.S. patent application Ser. No. 10/125,681 by Jones, incorporated by reference herein, interleaving methods for radial printing at faster-than-contiguously-capable spinning rates may be used with a radial and similarly the radial sled to print at rotational speeds well in excess of 500 RPM. Jones discloses techniques for ink jets to print ink objects in non-contiguous ink sectors during the first and subsequent rotations. As described in the aforementioned reference, printing on spinning media that exceeds print head-nozzle firing frequency can be successfully printed by interleaving a plurality of ink object firings from the ink jet print head such that no two consecutive firings for the same print head nozzle are fired on adjacent angular angles in a polar coordinate system. Thus employing Jones' interleaving methods techniques as disclosed and previously referenced herein and by spinning the drives approximately at 400 or 500 RPM constant angular velocity (CAV) with customized firmware, both with radial printing and radial sled printing, conclusively yields and satisfactory results during actually operation using these aforementioned techniques, using said Teac drives. At a spin rate of 500 RPM, CAV, laboratory results empirically printed a full-coverage surface at 600 DPI rendering in less than 60 seconds. Such radial and radial sled printing may therefore be performed with reasonable print quality and in reasonably fast elapsed time.

Figure 12:
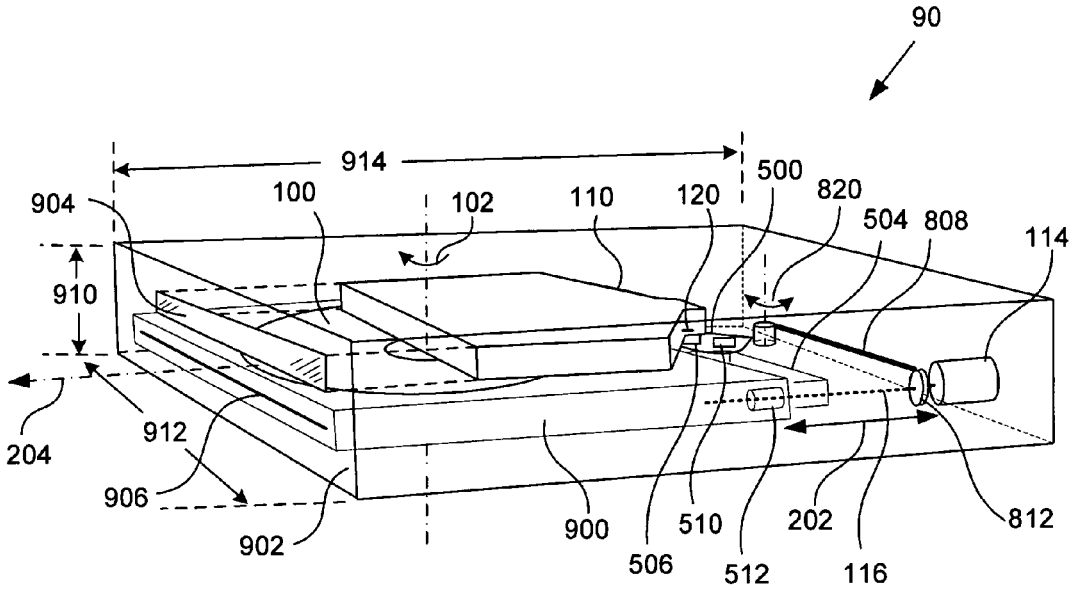
FIG. 12—Is a diagrammatic representation of aspects of an embodiment of the present invention configured the size of a standard, half-height CD drive.
Figure 13:
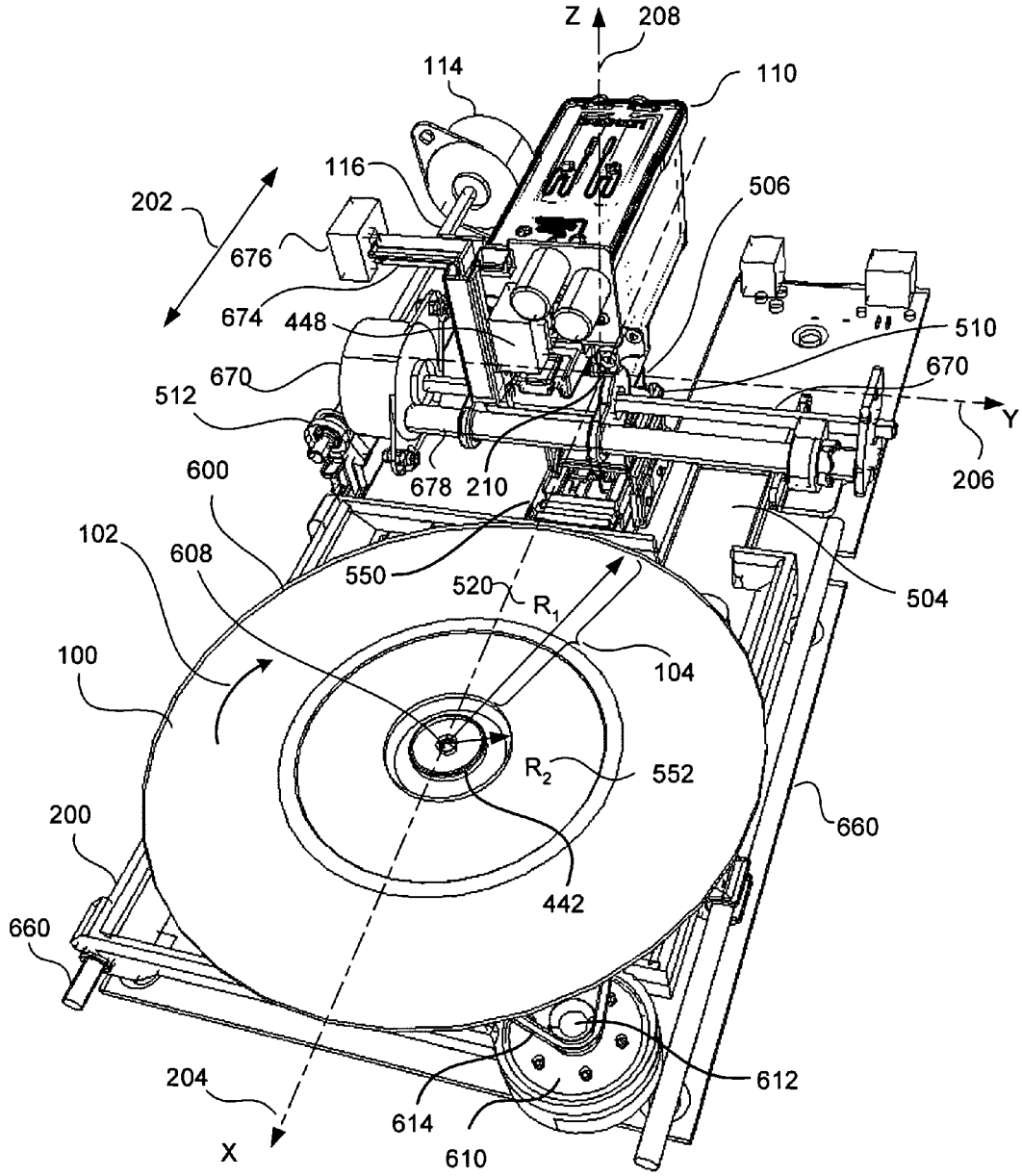
FIG. 13—Is a diagrammatic representation of aspects of an embodiment of the present invention configured for off-radius-axis positioning of the print head and slideable caboose maintenance station with sled in forward position.
Figure 14:
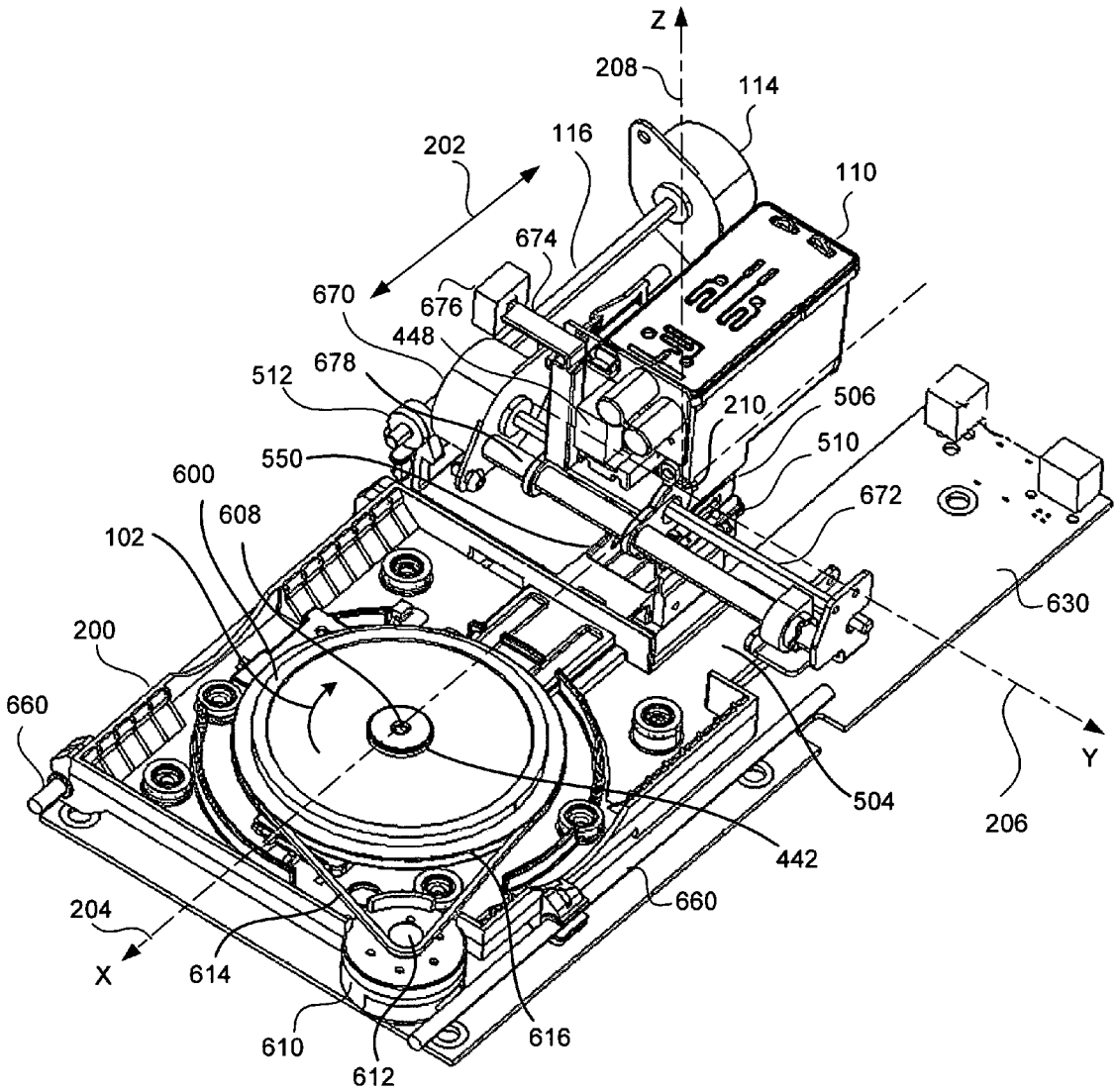
FIG. 14—Is a diagrammatic representation of aspects of an embodiment of FIG. 13 without CD installed.

Another alternative embodiment of the present invention, as is illustrated in FIG. 12, may be in the configuration of a standard-sized, computer-bay compatible, half-height CD drive. A slimline drive 900 may be configured with a lower-profile print head 110 as part of a standard-sized, half-height drive system 90. This half-height radial sled printer configuration 90 permits installation of the radial sled printer system 50 into a standard computer bay, as similarly disclosed in co-pending U.S. patent application Ser. No. 10/159,729 by Randy Q. Jones et al, incorporated by reference herein. In contrast to the aforementioned application, which discloses an all-in-one cartridge, low-profile ink head cartridge with integrated movement mechanism and maintenance station, the present invention may be configured instead to use a conventional print head with an external maintenance station all within the configuration of a standard-sized, half-height 910 drive. Half-height system 90 is configured with a standard drive 900 in a shape of size approximately 148 mm wide 912 by 44 mm high 914 and 208 mm deep 910. To permit ink cartridge installation via the front of the computer bay, front panel 902 may be configured with door 904 allowing insertion of print head cartridge 110 via the front. The print head cartridge 110 may be configured to be approximately 15 mm in height so as to fit into door 904 and may be approximately 140 mm in length to insert completely past the load position of drive 900. Drive 900 may be configured as an operable radial sled 200 as previously discussed above in FIG. 9~10 and is aligned to slide along x-axis 204 centered with print head nozzles 120. Similarly, half-height drive 900 may be configured with a maintenance arm 500, spit station 504 and cam-operated, clutch-engaging drive transfer mechanism 820 from screw drive gear 812, transferring power via belt 808 from motor 114 to rotate maintenance arm 500. Similarly, for example to affect printing using ink jet technology, the drive 900 precesses along x-axis 204 following path 202, actuated by sled nut 512 from lead screw 116 and motor 114, while print head 110 ejects ink objects onto spinning 102 media 100. Drive 900 may be configured with customized firmware to spin at approximately 500 RPM of slower.

In an alternate embodiment of the present invention, the slimline drive 900 may be replaced by a custom-designed drive configured with similar dimensions and functionality. Such a device may reduce further costs by utilizing standard drive components and technology configured in a diminutive fashion. For example, sled motion motor 114 may be configured to combine it with the optical laser unit servo motor and thus further lower costs, since the laser servo motor is idle during printing and the sled motor is idle during recording. Higher speed components may be configured into this diminutive configuration than normally allowed for laptop slimline drive use, where battery power is a more critical design criterion; as such, full-rated performance yet slimmer drives could be fashioned and configured to include the slimline printing cartridge, as previously disclosed herein.

Combination Ink Jet Printer and Radial Sled and CD/DVD Recorder Printer

Figure 20:
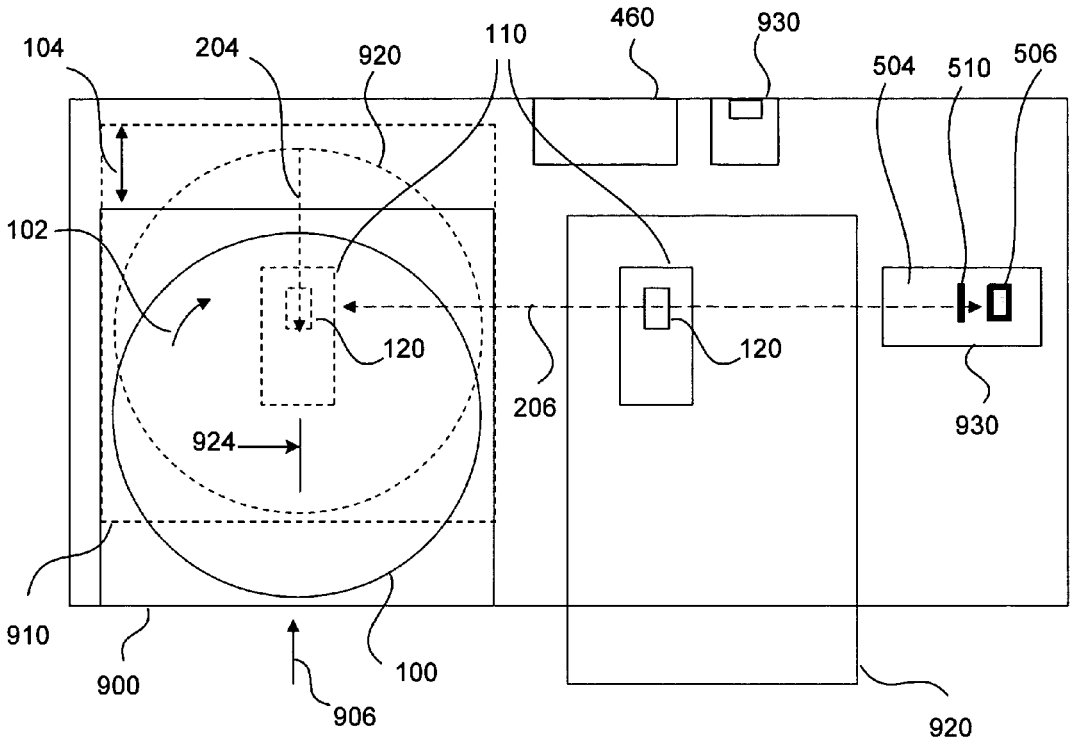
FIG. 20—Is a diagrammatic representation of aspects of an embodiment of the present invention configured as a combination ink jet photo printer and radial sled recorder printer, showing a top-down functional view.
Figure 21:
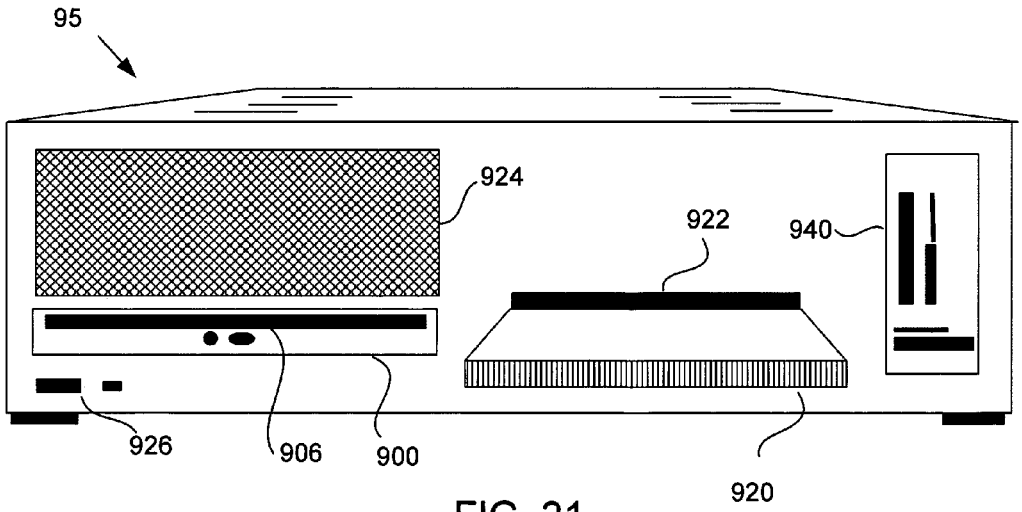
FIG. 21—Is a diagrammatic representation of aspects of an embodiment of the present invention configured as a combination ink jet photo printer and radial sled recorder printer, showing a front view of the apparatus.

In yet another embodiment of the present invention as depicted in FIG. 20~21, an inkjet printer may be operably configured with a mechanism including an extended slide and control system to position the print head 110 over an area to a side of the normal print area for paper, so as to substantially hoover over a radial sled mechanism configured with a slimline CD/DVD disc 900, as shown in FIG. 20. During printing, the print head 110 is held in a plurality of stationary positions near or parallel to the radial center line while the radial sled platter or slimline disc spins the printable side of the media positioned substantially perpendicular to the exit nozzle array for discharging jetted ink from the print head cartridge 110, typically underneath the print head 110. While printing, the printer imagining control system 460 may slightly reposition the print head 110 along y-axis 206 to allow a plurality of sets of nozzles to align optimally for printing off-radial-axis substantially near the on-radius printing area of the media, as previously disclosed herein in the section entitled, "Radial Sled Printer." In FIG. 20, the print head 110 hovers in a substantially stationary fashion over the printable media 100 at position 924. Typically during operation, imaging control system 460 may slightly nudged or reposition the cartridge to more optimally align nozzle rows representing individual colors, such as cyan, magenta and yellow, and thus realign the plurality of nozzles for better print results, near or off-radial axis. Disc 900 functions as a sled 200 during printing, moving rearward along x-axis 204; when all the way rearward, and print head 110 has been substantially into positioned 924, sled drive 900 moves forward along x-axis 204 over the distance 104, while print head 110 prints as controlled by imagining control system 460, similar to the method previously described the section entitled, "Combination Radial Sled Printer and CD/DVD Recorder."

As shown in FIG. 21, the present embodiment advantageously combines the functions of conventional ink jet printer with a radial sled printing while utilitizing the same ink jet print head cartridge 110 for both purposes. An example print head 110 for such multiple use may be the Lexmark 35 cartridge, which is approximately 2 inches in height, which cartridge allows for a reasonably compact overall design, such as for a home entertainment center device. In this later case, an alternative configuration of the present invention may be configured with an RF module 930 to allow displaying information and menus on a television or other connection to a computer and/or monitor, to preview digital content on the DVD or CD media or optional film card reader 940. An example of use with this configuration of the present invention may be to allow users to place digital film cards into the film card reader 940, record contents to CD or DVD drive 900, print a label on the media 100 using the sled printer imaging control system 460 and mechanism, browse the contents of the CD/DVD using menus on the TV and a remote to view pictures, and finally select and print a plurality of photos via the photo paper tray 920, with the printed photo exiting paper tray outlet 922, all performed within one apparatus 95. Observation window 924 may be configured to allow users to view the radial printing process, with an optional light activated via button 926. After printing is finished, print head 110 is moved along y-axis 206 into shared maintenance station 930, among which the function of cleaning nozzle into the spittoon 504, wiping 510 and capping 506 may be performed. Of course, other methods combining these activities in various sequences may be performed with the present invention. By using lower profile ink cartridges, as disclosed in referenced patent application herein, overall printer design heights may be even further reduced for all devices disclosed in the present invention.

Alternatively, Disc 900 may be configured in an assembly that can be inserted into the paper tray space 920 and thereafter engaged with controls and or power connections to transmit Disc 900 under print head 120 while spinning the media for printing. In this embodiment, the lateral dimension of printer of FIGS. 20 and 21 is reduced while still allowing use of the printer's print head and print head service bay.

In alternate embodiments of the present invention the radial sled printing mechanism may be configured as a standalone unit that can receive data input from sources such as memory cards, mp3 players, picture phones, handheld computers, telephone wireless connection, wifi connection, infrared connection, or bluetooth connection, without the use of a host computer and then transfer data from the memory card to and record on a CD or DVD and also print a label comprising graphics and or text representing aspects of the data recorded onto the CD. Such labels may be in the form of preconfigured templates relating to types of data burned on the CD's or DVD's and may optionally be selected by the user via interface on the mechanism. For example, when the memory card contains data representing digital pictures, the label may product thumbnail representations or all or some of the pictures. It may also include date information relating to all or some of the pictures. For example, the mechanism may print only a thumbnail of the first picture of each date of pictures on the memory card, thereby providing an index of days or events represented by the pictures. Alternatively, the thumbnails could comprise the first few and last few of a group of pictures with the current date, all generated automatically by the mechanism.

In an alternative embodiment, the mechanism could receive information relating to video data via standard means, such as 1394 connection, USB connection, video streaming, or analog/audio/video inputs. The mechanism could automatically or at the user's option print on the label thumbnails comprising a unique frame of the video data for each separate scene or date represented by the video data. Alternate schemes for printing of thumbnails representing the video data can be configured. In an alternate embodiment the mechanism can include sufficient data memory buffer so that for real time data streaming, the user could be prompted to remove a filled disc and replace with a fresh disc, while the mechanism could print label information including consecutive numbers for disc identity in a series, such as "disc 1" or "disc 2". Additionally with sufficiently large memory buffer additional copies of a disc could be created and also labeled.

In another embodiment the device could include an image scanning mechanism over the sled so that label information of an existing disc could be scanned, copied, and replicated on a copy disc while the disc is spinning. The digital contents of the original disc could also be copied onto the copy disc in the same or sequential operation.

The previously described embodiments may be configured to operate either in a standalone mode or in conjunction with a host computer or data processing apparatus.

The exemplary concept and novel use of radial sled printing as defined in the present invention illustrate the overall principle and application of the more general solution for a highly integrated system for recording and label printing circular media in a single insertion of the media. While this invention has been described in terms of several preferred embodiments, there are alterations, permutations, and equivalents, which are all within the scope of this invention. For example, a standard, half-height-sized CD or DVD recordable drive may be alternatively implemented and configured as the moveable sled in the present invention. It is therefore intended that the following appended claims be interpreted as including all such alterations, permutation, and equivalents as they fall within the true spirit and scope of the present invention.

We claim:

1. An apparatus adapted to print graphical or text information on a surface of a rotatable flat medium, comprising:

a print head a rotatable mechanism adapted to hold and rotate the flat medium the rotatable mechanism also adapted to be moved in a lateral direction in relation to the print head while simultaneously spinning the medium to enable printing of information on the medium by the print head, and wherein the mechanism is adapted such that the medium is moved laterally in incremental steps;

wherein the rotatable mechanism comprises a sled movable during printing in a lateral direction in relation to the print head, and further comprising a print head maintenance station operably connected to the sled in such fashion that components of the maintenance station cap the print head in a first position and move in conjunction with lateral movement of the sled and in a direction substantially aligned parallel with respect to the sled motion to a second position in which the print head is not capped by components of the maintenance station.

2. The apparatus of claim 1, further comprising bar to dry or cure the medium.

3. The apparatus of claim 1, further comprising an optical reader adapted to scan the surface of the spinning medium.

4. The apparatus of claim 1, wherein the print head is an ink print head.

5. The apparatus of claim 1, wherein the print head is a light or laser emitting source.

6. The apparatus of claim 1, further comprising an ink jet pen maintenance station.

7. A method of printing graphical or text information on a surface of a rotatable flat medium, comprising:

placing the medium on a mechanism adapted to receive the medium;

rotating the medium;

simultaneously moving the medium laterally in incremental steps while the medium is rotating;

printing on the medium in incremental print operations coinciding with lateral movement pauses between successive incremental lateral movement steps of the medium; and moving the medium in a lateral direction in conjunction with moving a maintenance station cap in an approximately parallel lateral direction to uncap a print head used for printing on the medium prior to the step of simultaneously moving the medium in incremental steps.

8. The method of claim 7, wherein the incremental steps are approximately the size of a nozzle array of any increment thereof.

9. The method of claim 7, further comprising computing an approximate nozzle or nozzles of the print head to fire.

10. The method of claim 7, wherein the printing comprises printing on a line that is parallel to a radial axis and within an area bounded by parallel lines that run from opposing edges of a hub to an outer edge of the medium, wherein the parallel lines are parallel to the radial.

11. The method of claim 7, further comprising using a signal to determine an instantaneous angular position of the spinning medium.

12. The method of claim 7, further comprising using polar rendering to convert a position of the spinning medium from polar coordinates to Cartesian coordinates.

13. The method of claim 7, further comprising curing an image printed on the medium.

14. The method of claim 7, further comprising using an optical scanner to recognize a mark on the medium and using the location of the mark to set a zero angle starting point.

15. The method of claim 7, wherein the printing comprises moving the medium such that at some time during the printing a print head is above a hub that holds the medium and at another time during printing the print head is above the outer edge of the medium, such that the print head can reach anywhere from the outer most radius to the inner most radius of the medium.

16. The method of claim 7, wherein the printing on the medium step occurs simultaneously with recording data onto the medium.

17. The method of claim 7, further comprising using a sensor to determine whether the medium is present prior to printing.

18. The method of claim 7, wherein the printing step comprises visually altering the surface of the medium.

19. A method of printing graphical or text information on a surface of a rotatable flat medium, comprising:

placing the medium on a mechanism adapted to receive the medium;

rotating the medium;

moving the medium laterally in a first incremental step while the medium is rotating;

after moving the medium the first incremental step, printing on a first portion of the medium;

moving the medium in a lateral direction in conjunction with moving a maintenance station cap in an approximately parallel lateral direction to uncap a print head used for printing on the medium prior to the step of printing on a first portion of the medium;

after printing on the first portion of the medium, moving the medium laterally in a second incremental step while the medium is rotating; and after moving the medium the second incremental step, printing on a second portion of the medium generally radially displaced from the first portion.

* * * * *